US011703309B1

(12) United States Patent
Blount et al.

(10) Patent No.: US 11,703,309 B1
(45) Date of Patent: Jul. 18, 2023

(54) FOOTPATH ILLUMINATION RAIL MOUNT LOW PROFILE DUAL SOURCE

(71) Applicants: Terry Blount, Fort Riley, KS (US); David Gerrells, Morrison, CO (US)

(72) Inventors: Terry Blount, Fort Riley, KS (US); David Gerrells, Morrison, CO (US)

( * ) Notice: Subject to any disclaimer, the term of this patent is extended or adjusted under 35 U.S.C. 154(b) by 0 days.

(21) Appl. No.: 17/329,112

(22) Filed: May 24, 2021

Related U.S. Application Data

(63) Continuation-in-part of application No. 16/600,230, filed on Oct. 11, 2019, now abandoned.

(60) Provisional application No. 62/744,440, filed on Oct. 11, 2018.

(51) Int. Cl.

| | |
|---|---|
| ***F41G 11/00*** | (2006.01) |
| ***F21V 21/14*** | (2006.01) |
| ***F41G 1/35*** | (2006.01) |
| ***F21V 23/04*** | (2006.01) |
| ***F21Y 115/10*** | (2016.01) |
| ***F21Y 113/10*** | (2016.01) |

(52) U.S. Cl.
CPC ..... *F41G 11/003* (2013.01); *F21V 21/14* (2013.01); *F21V 23/04* (2013.01); *F41G 1/35* (2013.01); *F21Y 2113/10* (2016.08); *F21Y 2115/10* (2016.08)

(58) Field of Classification Search
CPC . F41G 11/003; F41G 1/35; F41G 1/36; H05B 45/20; F21V 21/14; F21V 23/04; F21Y 2113/10; F21Y 2115/10
USPC ..... 362/110
See application file for complete search history.

(56) References Cited

U.S. PATENT DOCUMENTS

| | | | | |
|---|---|---|---|---|
| 5,584,137 A * | 12/1996 | Teetzel | F41A 9/62 | 362/114 |
| 7,735,255 B1 * | 6/2010 | Kincaid | F41C 33/041 | 42/146 |
| 2013/0235562 A1 * | 9/2013 | Chauvie | F41G 1/35 | 362/110 |

* cited by examiner

*Primary Examiner* — Andrew J Coughlin
*Assistant Examiner* — Jessica M Apenteng
(74) *Attorney, Agent, or Firm* — GableGotwals; David G. Woodral

(57) ABSTRACT

An accessory rail mountable light includes an accessory rail interface configured to selectively attach to an accessory rail of a firearm, the accessory rail being aligned with the bore of the firearm, at least one light activating button, and at least one light element. The at least one light activating button is reachable by an operator for selectively illuminating the at least one light element and the at least one light element illuminates an area in front and below the firearm when the firearm is pointed forward from an operator.

11 Claims, 22 Drawing Sheets

FOOTPATH ILLUMINATION RAIL MOUNT LOW PROFILE DUAL SOURCE

CROSS-REFERENCE TO RELATED CASES

This application is a continuation-in-part of U.S. patent application Ser. No. 16/600,230 entitled FOOTPATH ILLUMINATION RAIL MOUNT LOW PROFILE DUAL SOURCE filed on Oct. 11, 2019 which claims the benefit of U.S. provisional patent application Ser. No. 62/744,440 entitled FOOTPATH ILLUMINATION RAIL MOUNT LOW PROFILE DUAL SOURCE, filed on Oct. 11, 2018, the contents of which are hereby incorporated by reference.

FIELD OF THE INVENTION

This disclosure relates to field lighting in general, and more specifically, to weapon or tool mounted lighting.

BACKGROUND OF THE INVENTION

Lights have been made for mounting to accessory rail systems for weapons and other tools that can free an operator's hands from the need to hold and aim a light apart from aiming or using the weapon or tool. In the case of a weapon, lights have been mounted to point in the same direction as the bore, such that the target may be illuminated. However, operators continue to have need to illuminate areas that may not be ahead of the bore of the weapon, or toward which it may not be safe or reasonable to point a weapon.

What is needed is a system and method for addressing the above, and related, issues.

SUMMARY OF THE INVENTION

The invention of the present disclosure, in one aspect thereof, comprises an accessory rail mountable light having an accessory rail interface configured to selectively attach to an accessory rail of a firearm, the accessory rail being aligned with the bore of the firearm. The light has at least one light activating button, and at least one light element. The at least one light activating button is reachable by an operator for selectively illuminating the at least one light element and the at least one light element illuminates an area in front and below the firearm when the firearm is pointed forward from an operator.

In some embodiments, the at least one light element comprises at least two light elements emitting lights of different spectra. The at least one light activating button may comprise at least two light activating buttons corresponding to at the least two light elements. The at least two light elements may emit at least visible light and infrared light. In some cases, a first of the at least two light activating buttons is located rearward from a second of the at least two light activating buttons, and the first of the at least two light activating buttons activates the visible light and the second of the at least two light activating buttons activates the infrared light.

The accessory rail interface may be on a top panel of the light for attachment to an accessory rail below the bore of the firearm. The at least one light element may be on a front panel directing light in the direction of the bore, and at least one additional light element may be on a lower panel directing light about 45 degrees downward from the bore. The front panel may provide a hood shielding the at least one light element on the lower panel from shining in the direction of the bore. The at least one light activating button may be mounted in a recess on a side panel of the light.

The invention of the present disclosure, in another aspect thereof, comprises a weapon light having a body comprising a top panel, a bottom panel, a left panel, a right panel, a front panel, and a rear panel. The light has an accessory rail interface on the top panel configured to selectively attach to a weapon accessory rail below a bore of the weapon, the body then being aligned with the firearm such that the front panel is pointed in a same direction as the bore. A plurality of light control buttons are on left panel accessible to an operator of the firearm. The light includes a first plurality of lights capable of emitting light in plurality of spectra, the first plurality of lights being fixed with respect to the body to illuminate an area in front of and below the weapon light such that a footpath of the operator can be illuminated by the plurality of lights while the bore of the weapon is pointed away from the operator. A second plurality of lights is capable of emitting light in plurality of spectra, the second plurality of lights being fixed with respect to the body to illuminate an area in front of the bore of the weapon. The plurality of light control buttons may be selectively and independently activated to activate the first plurality of lights and the second plurality of lights.

The first plurality of lights may comprise a plurality of light emitting diodes. At least some of the first plurality of light emitting diodes may be affixed with respect to the body to emit light 45 degrees downward and forward from the body and the bore. The light may include a visor affixed to the body on the front panel shielding forward emission of light from the first plurality of light emitting diodes. The left panel may define a recess surrounding the plurality of light control buttons.

The invention of the present disclosure, in another aspect thereof, comprises a weapon light having a body having an upper panel with an accessory rail interface. A front panel joins to the upper panel and provides at least one forward facing light element. A lower panel joins to the front panel and provides at least one downward angled light element. A side panel joins the front panel and the lower panel and provides a first button controlling activation of the at least one forward facing light element and a second button controlling activation of the at least one downward angled light element. With the accessory rail interface attached to a weapon accessory rail below a bore of the weapon, the front panel directs the at least one forward facing light in a direction the bore points and the lower panel directs the at least one downward angled light below the direction the bore points.

In some cases, with the accessory rail interface attached to a weapon accessory rail below a bore of the weapon, the lower panel directs the at least one downward angled light to shine 45 degrees below the direction the bore points. A hood may shield the at least one downward angled light element from shining in the direction of the front panel. The hood may extend from the front panel.

The at least one downward angled light element may comprise a plurality of light emitting diodes (LEDs) emitting a plurality of spectra. The at least one forward facing light element may comprise a plurality of LEDs emitting a plurality of spectra.

BRIEF DESCRIPTION OF THE DRAWINGS

The drawings are described with respect to directions relative to a weapon/firearm bore. Top or superior would refer to the same direction as the top of upper portion of a firearm. It should be understood that these are relative directions, and may change based upon the direction a weapon is pointed with the various embodiments of the present disclosure installed thereon.

DETAILED DESCRIPTION OF THE PREFERRED EMBODIMENTS

Figure 1:
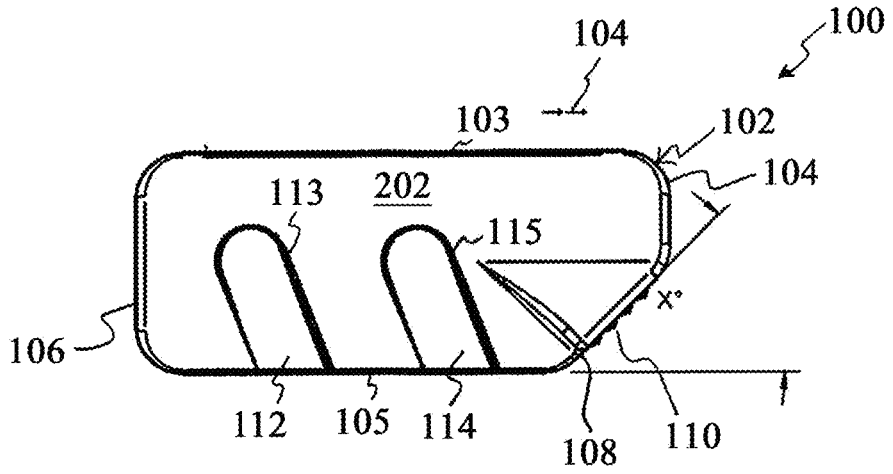
FIG. 1 is a side, or outside view of a rail mountable light according to aspects of the present disclosure.
Figure 2:
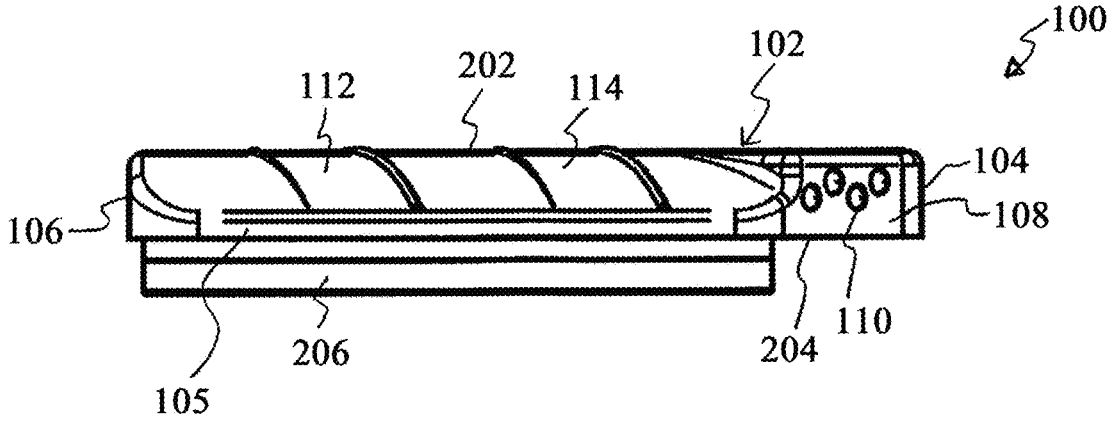
FIG. 2 is a bottom view of the rail mountable light of FIG. 1.
Figure 3:
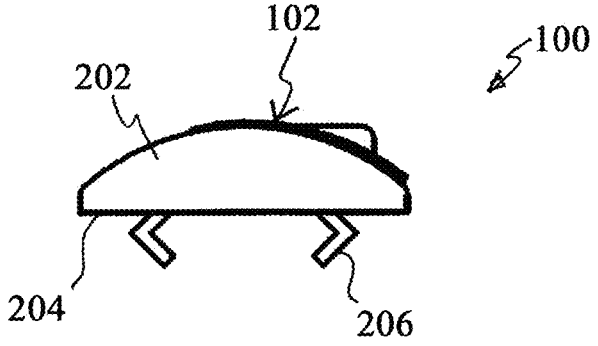
FIG. 3 is a back view of the rail mountable light of FIG. 1.
Figure 4:
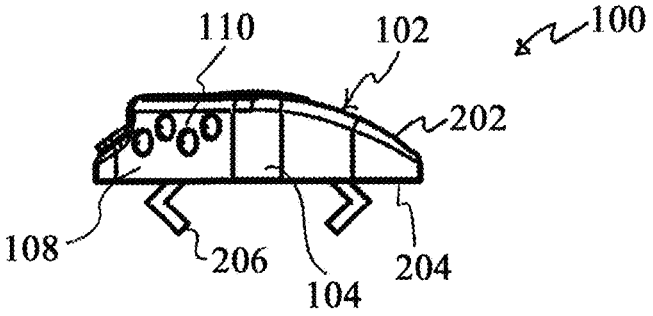
FIG. 4 is a front view of the rail mounted light of FIG. 1.
Figure 5:
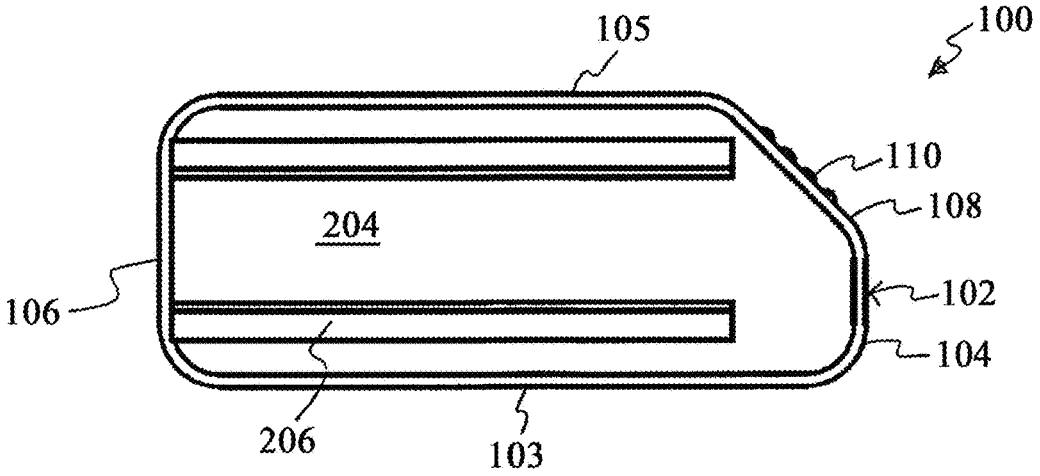
FIG. 5 is an inside view of the rail mountable light of FIG. 1.
Figure 6:
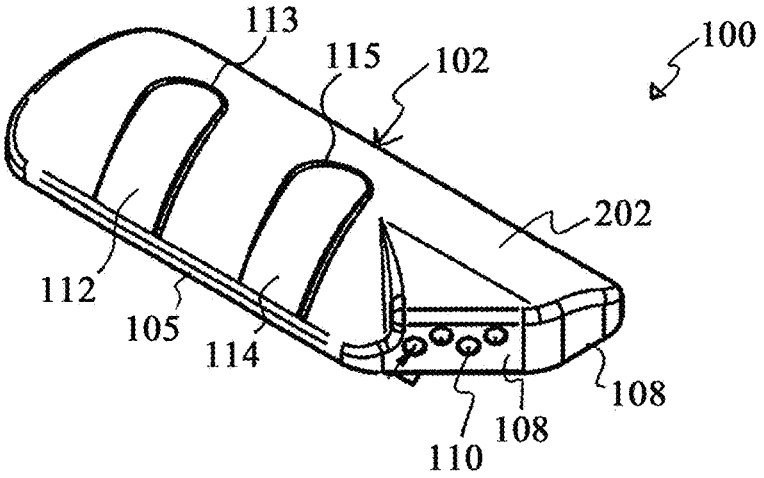
FIG. 6 is an outside perspective view of the rail mountable light of FIG. 1.
Figure 7:
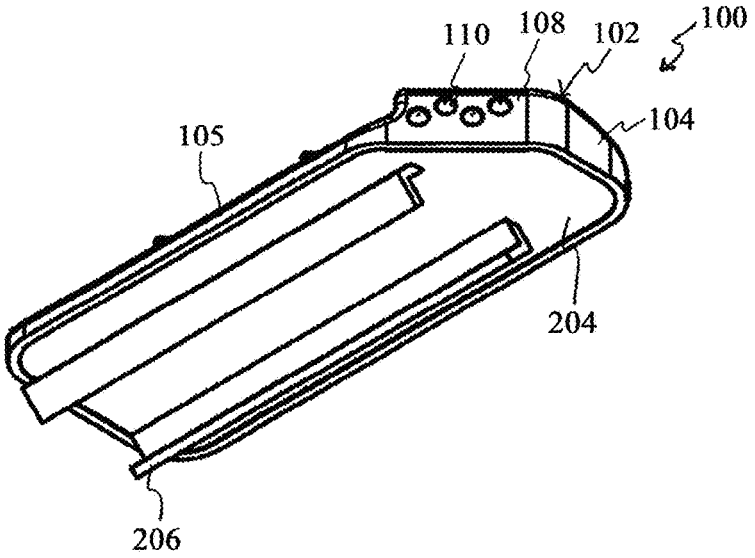
FIG. 7 is an inside perspective view of the rail mountable light of FIG. 1.

Referring now to FIG. 1 is a side, or outside view of a rail mountable light 100 according to aspects of the present disclosure is shown. FIG. 2 is a bottom view, FIG. 3 is a back view, FIG. 4 is a front view, FIG. 5 is an inside view, FIG. 6 is an outside perspective view, and FIG. 7 is an inside perspective view, all of the rail mounted light 100 of FIG. 1. These Figures, taken together, illustrate various embodiments and features of a rail mountable light, such as light 100, of the present disclosure.

The light 100 comprises a body 102 that may be considered as having a top side 103, a frontward end 104, a bottom side 105, and a back or rearward end 106. Apart from the orienting locations of the body, it may be physically constructed of at least two pieces—an outer shell 202 and an inner base 204. In some embodiments, the outer shell 202 may be dished or hollowed to create room for internal components. The base 204 may be flat or planar to close the outer shell. The outer shell 202 may have a snap fit or interference fit to the base 204 such that they can be separated to service internal components. In some embodiments, the outer shell 202 may affix to the base 204 with fasteners or adhesives. In some embodiments the joinder is sufficiently weatherproof that the light 100 will not fail in rain or from temporary immersion. In some embodiments the base 204 is rigid and may be made from nylon or another suitable polymer. The outer shell 202 may be more flexible or pliable and comprise a rubber compound with a durometer of 30-90.

In some embodiments the base 204 may differ from the illustrated planar configuration. For example, the base 204 may be dished and the outer shell 202 flat or relatively flat. In other examples the base 204 and outer shell 202 are both concave or dished to create room for internal components. However, as illustrated, the flat or planar base 204 allows the light 100 to mount close to a weapon, possibly substantially flush thereto, and the curved outer shell 202 fits well with the contour of an operator's hand or fingers.

Also formed from the outer shell 202, in the present embodiment, is a light pad 108. The pad 108 may provide a surface through which light elements 110 protrude from within the light 100. The light pad may be an integral component with the outer shell 102. The light elements 110 may be light emitting diodes (LEDs) capable of producing light with different colors or spectra. For example, one or more LEDs may provide visible light while one or more provide infrared light. Visible light may be white, red, green, or another color suitable to the operation and intended mission of the light 100. The light elements 110 may be oriented to provide light at an angle 'X' with respect to the bottom 105 of the body 102. In some embodiments this angle is 45 degrees but other useful angles may also be utilized. The light elements 110 may be thus configured to light a footpath of an operator of a weapon without the need to lower the weapon to bring straight bore mounted weapon lights to ground. In other words, the operator may light his or her path without removing a weapon from pointing on target.

If the light 100 is mounted such that the front 104 of the light 100 corresponds to the front of the associated weapon, a button 112 may be designated a rearward button, while a button 115 may be designated a frontward button. The forward button 114 may be operated by the index finger of the operator and correspond to activation of infrared light. The rearward button 112 may be operated by the middle finger or another finger. The buttons 112, 114 may be pressure sensitive such that no audible clicking is heard. The buttons 112, 114 may cause illumination of the respective LEDs only while pressed, or a single press may turn the lights on, and another press may turn them off. Other control schemes may be implemented as well. To aid in location of the buttons 112, 114 without having to look at them, tactile ridges 113, 115 may be located on, or otherwise surround, the respective buttons 112, 114.

The base 204 may provide a mounting system 206 for a firearm accessory rail to allow the light 100 to be selectively attached to the accessory rail. In some embodiments, the light 100 is configured to attach to a Picatinny rail or equivalent, as these are widely deployed and reliable. The mounting system 206 may be a pair of flexible legs or clamp to clip on to a Picatinny rail by grasping it from the outside. Thus, in some embodiments, the light 100 may be attached or detached quickly and without tools. In other embodiments the legs may be relatively inflexible such that they must slide onto the Picatinny rail. The legs of the mounting system may be aligned front to rear to affix the light 100 in line with the weapon bore, as Picatinny rails typically are.

Figure 8:
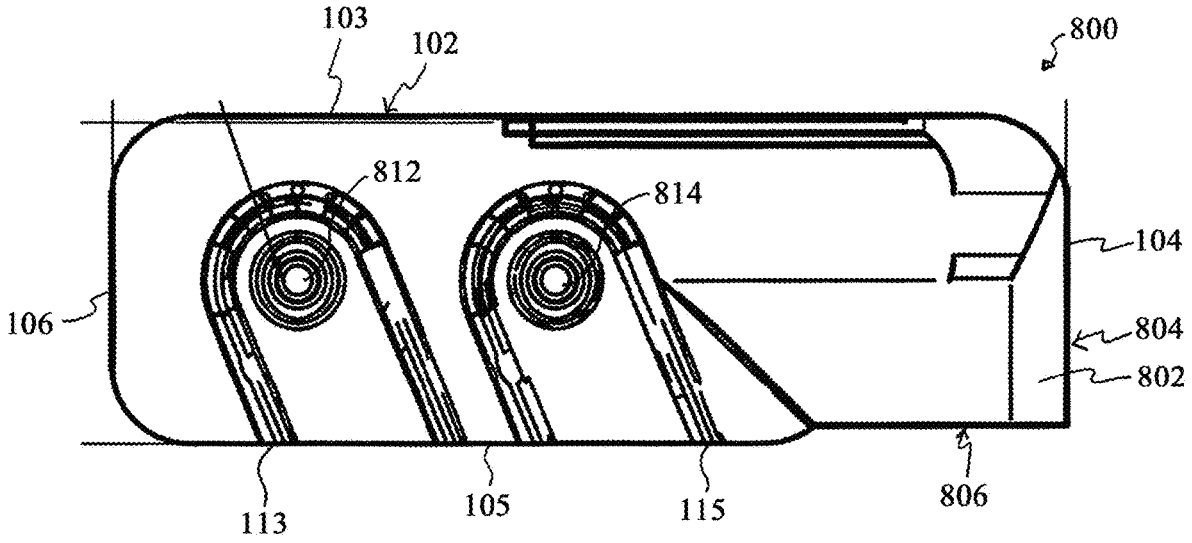
FIG. 8 is a side, or outside view of another rail mountable light according to aspects of the present disclosure.
Figure 9:
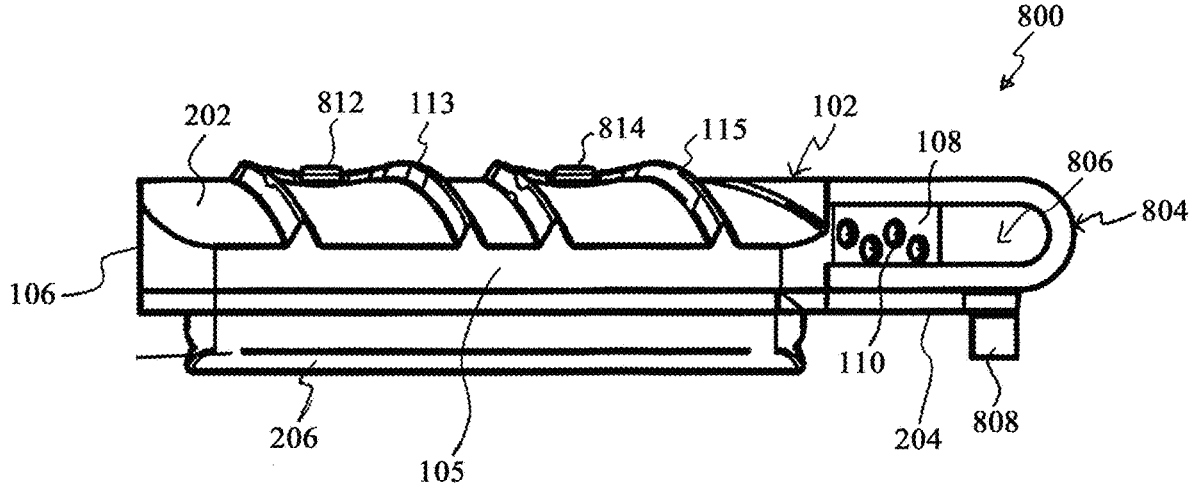
FIG. 9 is a bottom view of the rail mountable light of FIG. 1.
Figure 10:
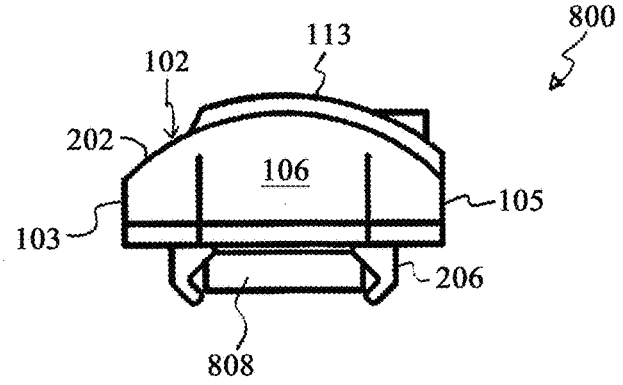
FIG. 10 is a back view of the rail mountable light of FIG. 1.
Figure 11:
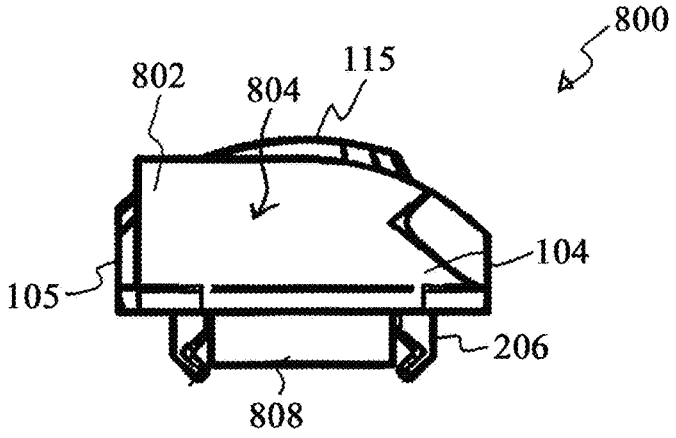
FIG. 11 is a front view of the rail mountable light of FIG. 1.
Figure 12:
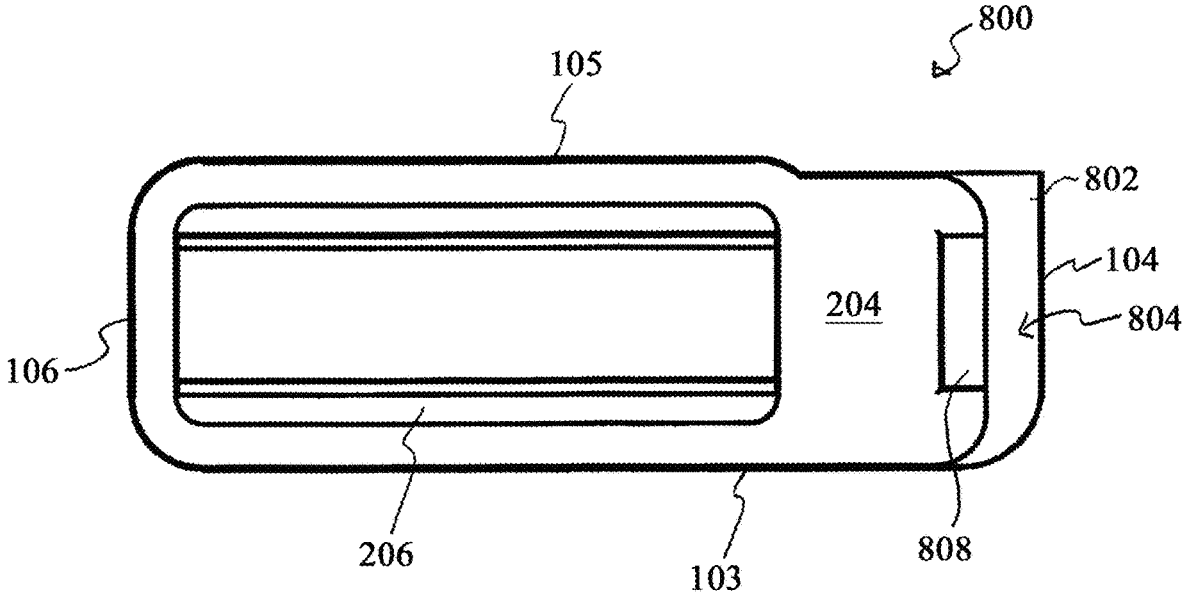
FIG. 12 is an inside view of the rail mountable light of FIG. 1.
Figure 13:
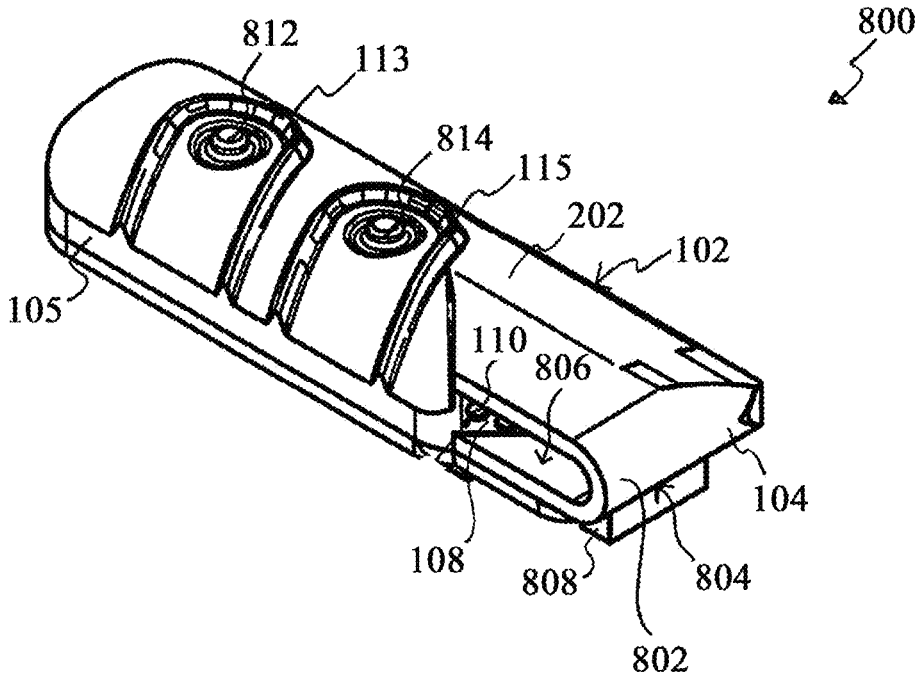
FIG. 13 is an outside perspective view of the rail mountable light of FIG. 1.
Figure 14:
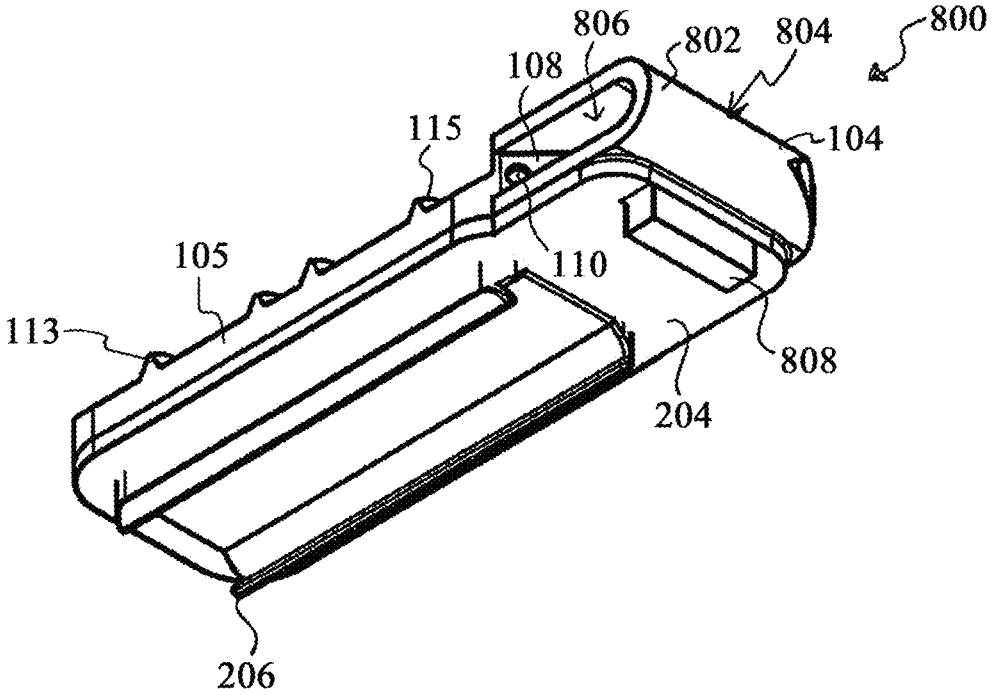
FIG. 14 is an inside perspective view of the rail mountable light of FIG. 1.

FIG. 8 is a side, or outside view of another rail mountable light 800 according to aspects of the present disclosure. FIG. 9 is a bottom view, FIG. 10 is a back view, FIG. 11 is a front view, FIG. 12 is an inside view, FIG. 13 is an outside perspective view, and FIG. 14 is an inside perspective view, all of the rail mountable light 800 of FIG. 8.

The light 800 shares many components with the light 100 previously described. For example, the light 800 comprises a body 102 formed generally from an outer shell 202 and a base 204. Light pad 108 serves to retain and/or direct lights from light elements 110 downward from the body 102 at a predetermined angle for lighting a footpath without need for lowering a weapon to which the light 800 may be attached. Again, multiple light spectra may be emitted by the light elements 110 including infrared and visible light including, but not limited to, white, green, and red.

Function of the light elements may be controlled by a rear button 812 and a forward button 814. The buttons 812, 814 have a different form factor that buttons 112, 114 previously described. The buttons 812, 814 may be raised, circular buttons rising from the outer shell 202. The buttons 812, 814 may be partially circumscribed on the shell 202 by tactile ridges 113, 115, respectively. Here again, the front button 814 may control illumination of IR light while the rear button 812 controls illumination of visible light.

The base 204 may provide the accessory rail interface 206 as described above, but may also provide a boss 808 for fitting into a slot of a Picatinny rail or equivalent to reduce the chance of inadvertent forward or rearward movement of the light 800 along the rail to which it is installed.

The light 800 provides a hood or visor 804 that covers the light elements 110 as viewed from the forward direction 104 as seen throughout the various views. A downward directed opening 806 allows for light elements 110 to adequately light a footpath area while minimizing the chance that the light elements 110 are visible forward of the light 800, which could betray an operator's position. The spacing from the light elements 110 of the visor 804, the angle of the light elements 110 and/or light pad 108, as well as the length and shape of a nose 802 of the visor 804 may be configured in concert to fine tune the lighting delivered to a footpath while minimizing unwanted forward lighting. In some embodiments, the visor 804 comprises a plastic or rubber material such that the nose 104 can be trimmed as desired to adjust the degree of forward lighting.

During installation, the visor 804 and the forward end of the base 204 may be sufficiently flexible with only hand pressure such that the boss 808 can be moved aside while the clamp or legs 206 are slid onto an accessory rail. The boss 808 may then be allowed to move into a rail slot. In other embodiments the base 204 may be substantially rigid and the boss 808 located on the visor 804 and allowed to proceed inwardly (toward the weapon, into an accessory rail slot) through a slot cut into the base 204. In some cases, the boss 800 may extend inwardly to the rail slot beyond the forward end of the base 204. In event the visor 804, or at least the nose 802 may be flexible to allow the boss 808 to be moved aside or displaced during installation of the light 800 and then return to its original position to occupy a space in a slot of an accessory rail.

Internal circuitry of the lights 100/800 may vary according to application. Several example circuit board configurations are shown in FIGS. 15-38.

Figure 15:
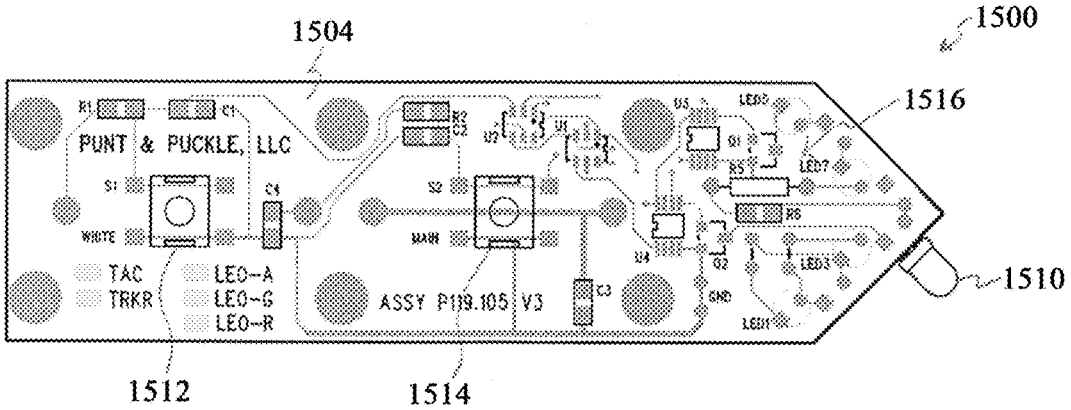
FIG. 15 is an outside surface view of one embodiment of a circuit board for a weapon light according to aspects of the present disclosure.
Figure 16:
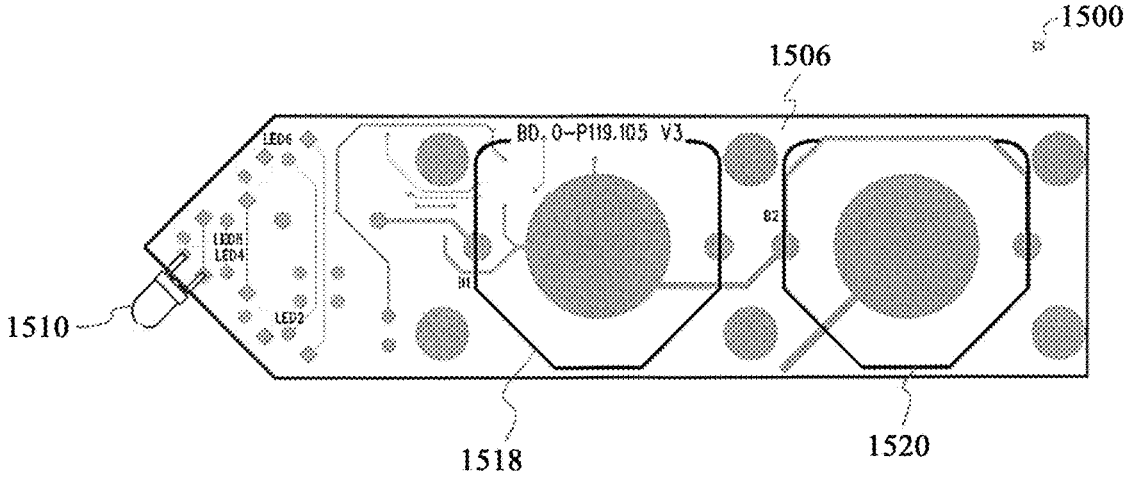
FIG. 16 is an inside surface view of the circuit board of FIG. 15.

FIG. 15 is an outside surface view of one embodiment of a circuit board 1500 for a weapon light according to aspects of the present disclosure. FIG. 16 is an inside surface view of the circuit board 1500 of FIG. 15. The circuit board 1500 might be considered a "right handed" circuit board. It may be used with a case or housing (e.g., 102/802) intended for use on the right side of a weapon, for activation by the operator's left hand.

Here a single LED 1510 functions as the light elements 110. Accordingly, the circuit board 1500 may only product a single color of light (IR, white, green, red, etc.). On a first, outer side 1504 (outer side) of the circuit board 1500 activation switches 1512, 1514 can be seen. These may correspond to buttons 112, 114 of light 100, respectively. The activation switches 1512, 1545 may also correspond to the buttons 812, 814 of light 800, respectively. The respective buttons may be used to activate the respective switches on the circuit board 1500 inside the light 100/800. Also seen on the inner side 1504 of the circuit board 1500 is light control circuitry 1516, which may include, without limitation, transistors, resistors, capacitors, chips and other devices necessary to safely operate the LED 1510 (or other light elements) safely and reliably based on input from one or more controls such as switches 1512, 1514.

The second, inner side 1506 provides the electrical connection to the LED 1510 in the present embodiment. Two battery terminals 1518, 1520 can be seen for accepting replaceable batteries to power the circuit board 1500 and light 100/800. In one embodiment compatible batteries are CR2032 or equivalent.

Figure 17:
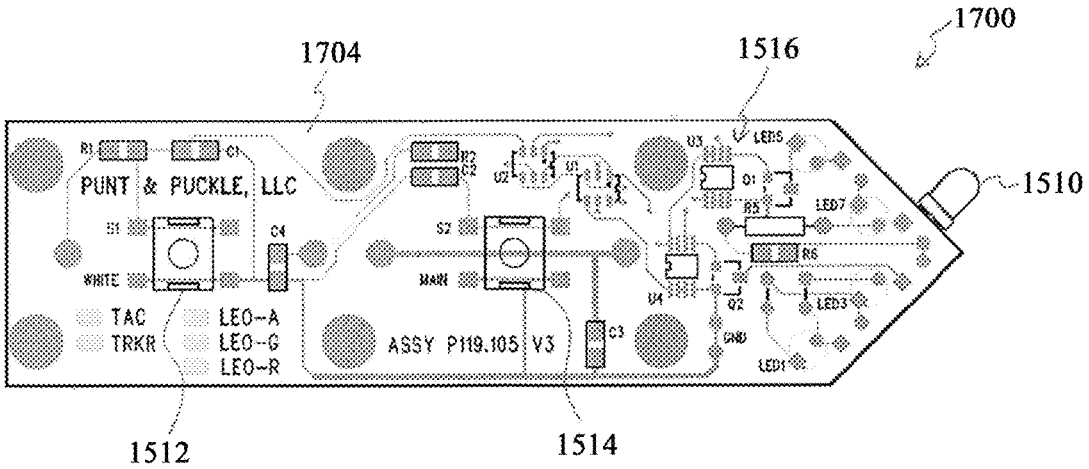
FIG. 17 is an outside surface view of another embodiment of a circuit board for a weapon light according to aspects of the present disclosure.
Figure 18:
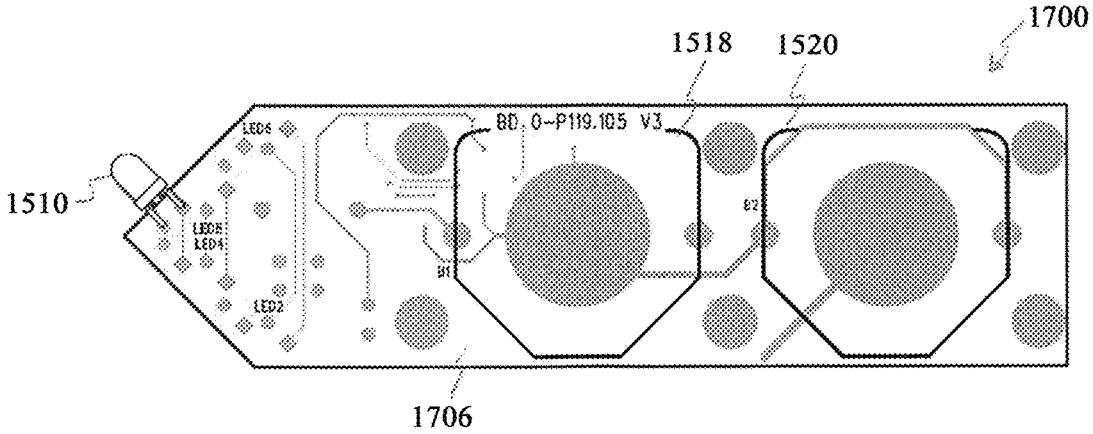
FIG. 18 is an inside surface view of the circuit board of FIG. 17.

FIG. 17 is an outside surface view of another embodiment of a circuit board 1700 for a weapon light 100/800 according to aspects of the present disclosure. FIG. 18 is an inside view of the circuit board 1700. The circuit board 1700 is functionally equivalent to the circuit board 1500 except for being a "left handed" model. The circuit board 1700, in conjunction with a left handed housing, is operable for installation on the left side of a firearm for operation by the operator's right hand or fingers. Accordingly, the circuit board 1700 has a first side 1704 that corresponds to the first side 1504 of circuit board 1500 except that the components are installed in a mirrored fashion. Similarly, a second side 1706 of the circuit board 1700 corresponds to second side 1506 of the circuit board 1500 except for mirroring of the installed components.

Figure 19:
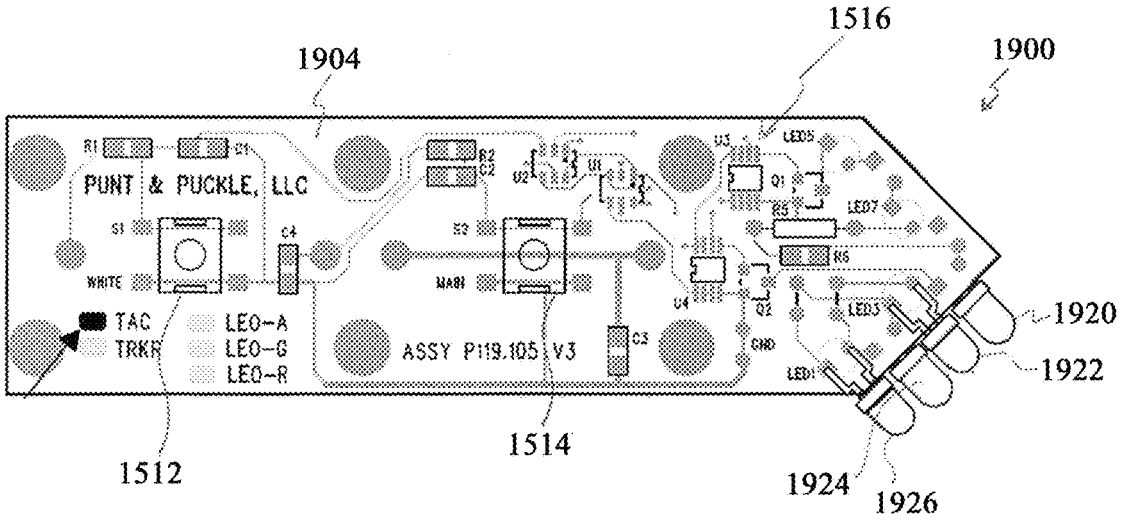
FIG. 19 is an outside surface view of another embodiment of a circuit board for a weapon light according to aspects of the present disclosure.
Figure 20:
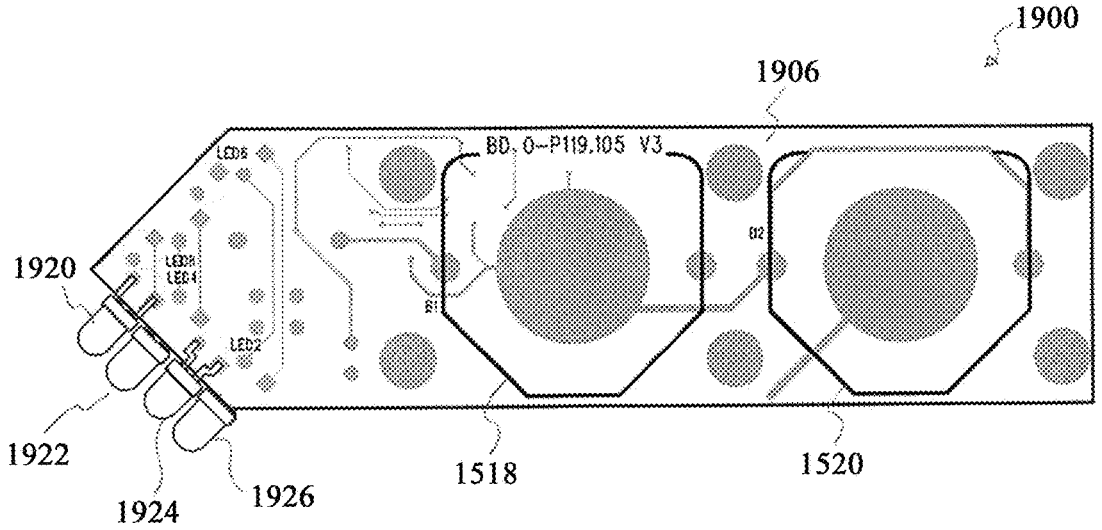
FIG. 20 is an inside surface view of the circuit board of FIG. 19.

FIG. 19 is an outside surface view of another embodiment of a circuit board 1900 for a weapon light according to aspects of the present disclosure. FIG. 20 is an inside surface view of the circuit board 1900. The circuit board 1900 is a right handed version with switches 1512, 1514 on a first surface 1904 and battery terminals 1580, 1520 on a second surface 1906. Here there are four separate LEDs 1920, 1922, 1924, 1926. These may be a combination of visible and IR LEDs that are activated by switches 1512, 1514 corresponding to the buttons 112, 114 or 812, 814 on the respective housing 102, 802.

Figure 21:
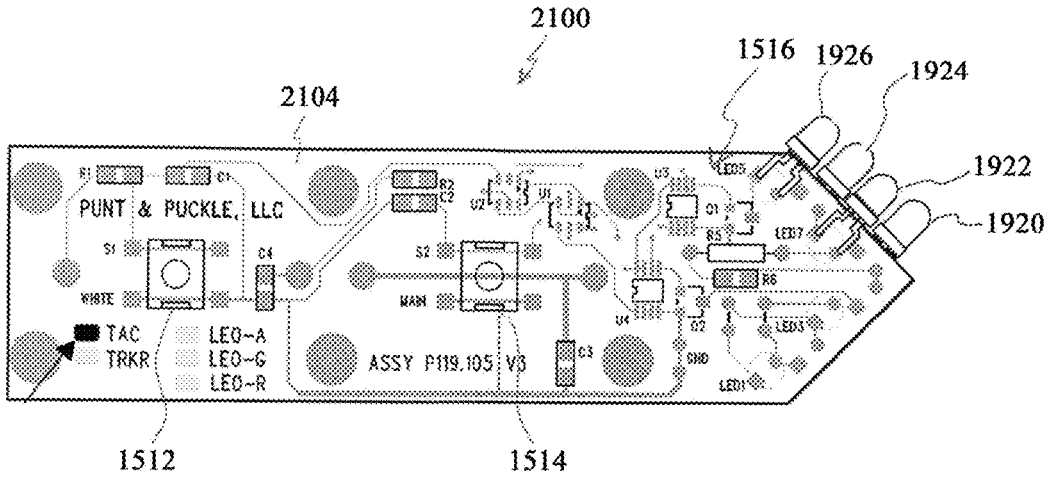
FIG. 21 is an outside surface view of another embodiment of a circuit board for a weapon light according to aspects of the present disclosure.
Figure 22:
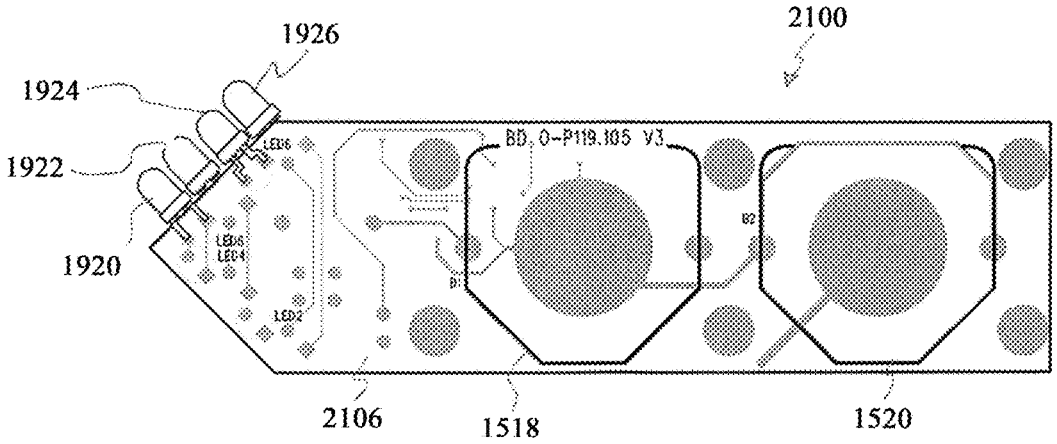
FIG. 22 is an inside surface view of the circuit board of FIG. 21.

FIG. 21 is an outside surface view and FIG. 22 is an inside surface view of the left handed circuit board 2100 version of the circuit board 1900. Again, the outer side 2104 and inner side 2106 correspond to outer side 1904 and inner side 1906, respectively, except for reversal of the location of components.

Figure 23:
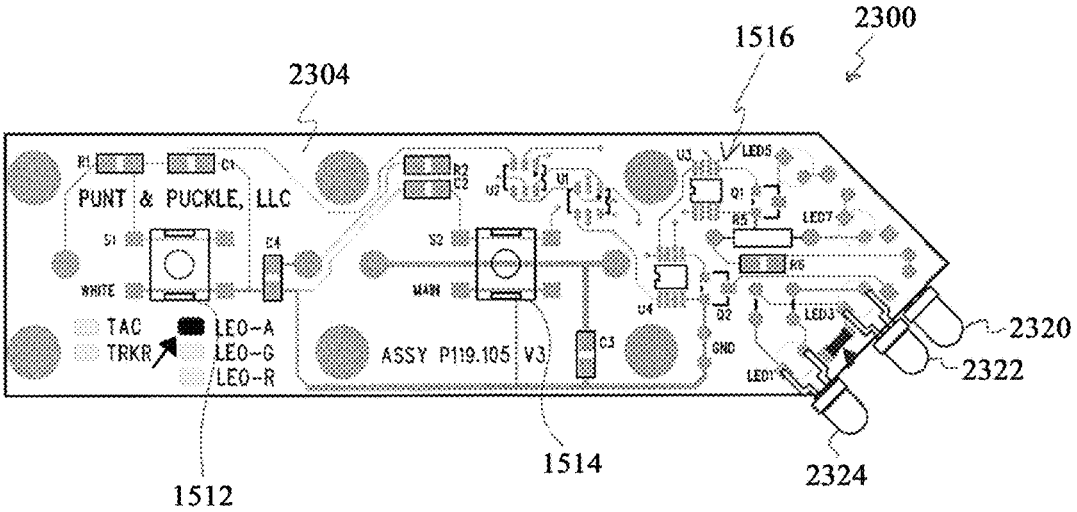
FIG. 23 is an outside surface view of another embodiment of a circuit board for a weapon light according to aspects of the present disclosure.
Figure 24:
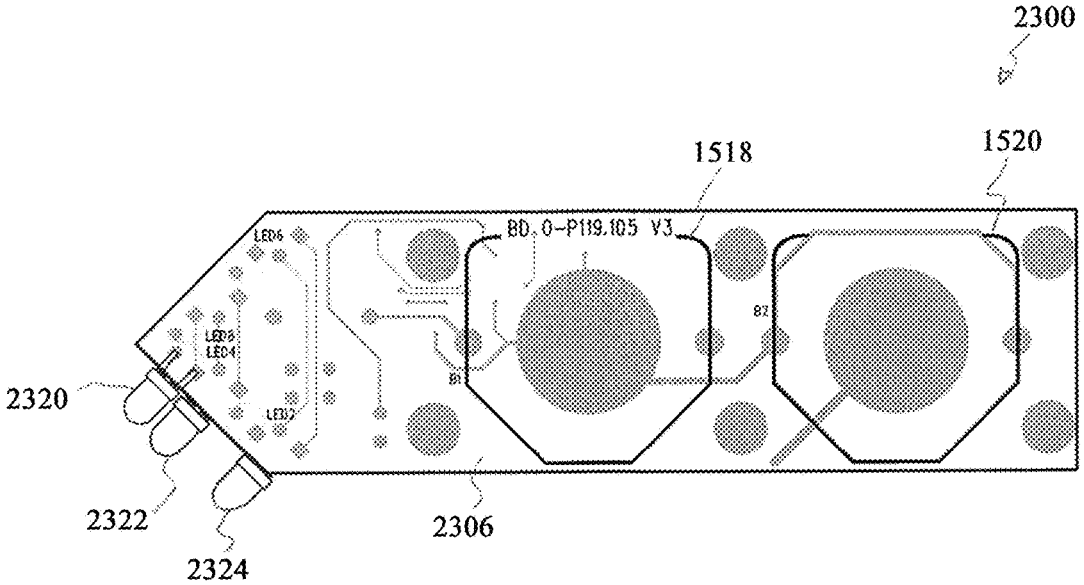
FIG. 24 is an inside surface view of the circuit board of FIG. 23.

FIG. 23 is an outside surface view of another embodiment of a circuit board 2300 for a weapon light according to aspects of the present disclosure. FIG. 24 is an inside surface view of the circuit board 2300. The circuit board 2300 is a right handed version with switches 1512, 1514 on a first surface 2304 and battery terminals 1580, 1520 on a second surface 2306. Here there are three separate LEDs 2320, 2322, 2324. These may be a combination of visible and IR LEDs that are activated by switches 1512, 1514 corresponding to the buttons 112, 114 or 812, 814 on the respective housing 102, 802.

Figure 25:
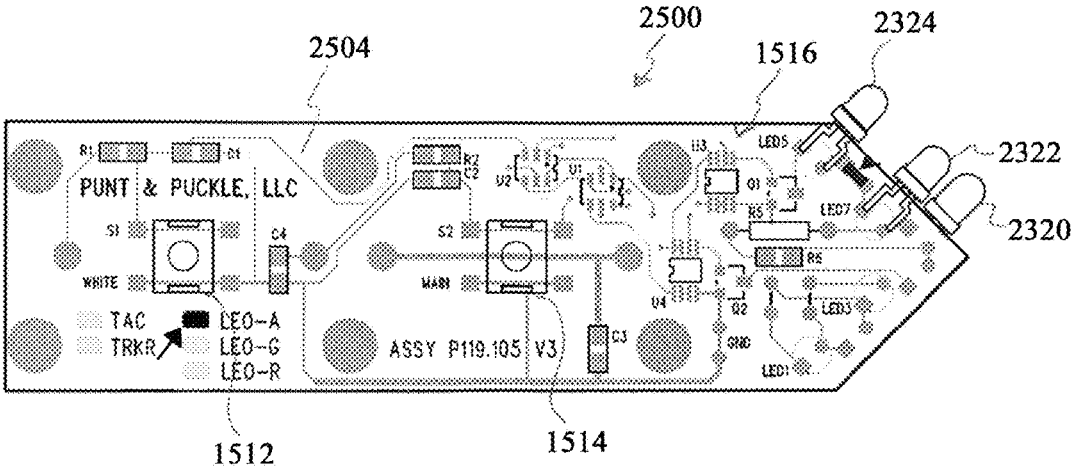
FIG. 25 is an outside surface view of another embodiment of a circuit board for a weapon light according to aspects of the present disclosure.
Figure 26:
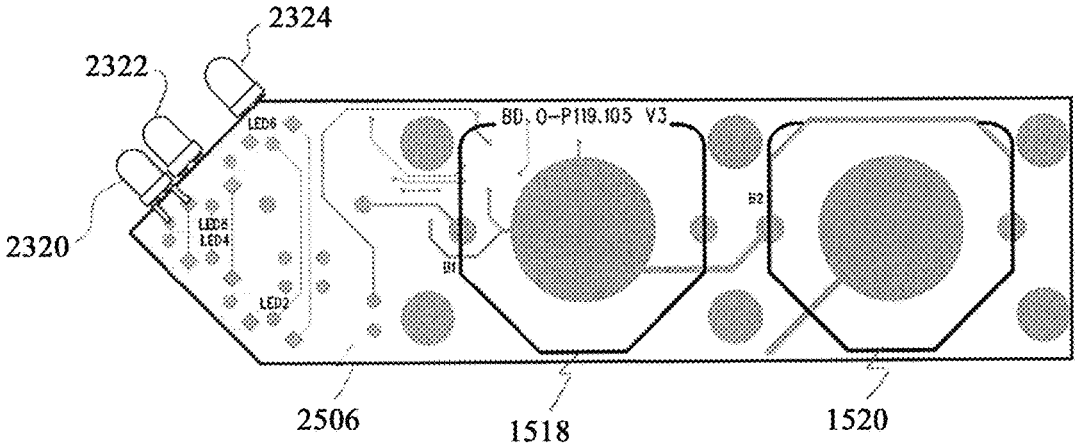
FIG. 26 is an inside surface view of the circuit board of FIG. 25.

FIG. 25 is an outside surface view and FIG. 26 is an inside surface view of a left handed circuit board 2500 version of the circuit board 2300. Again, an outer side 2504 and inner side 2506 correspond to outer side 2304 and inner side 2306, respectively, except for reversal of the location of components.

Figure 27:
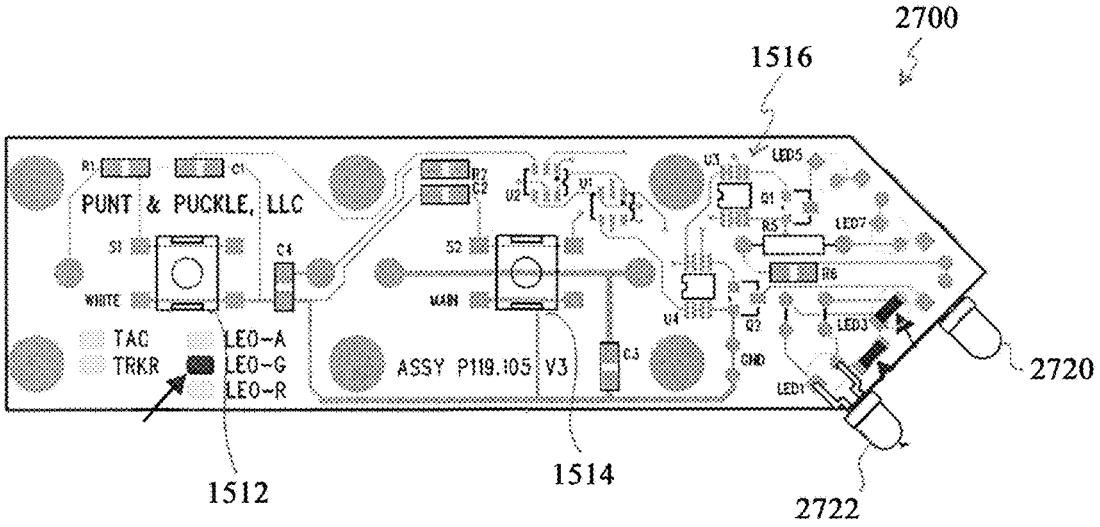
FIG. 27 is an outside surface view of another embodiment of a circuit board for a weapon light according to aspects of the present disclosure.
Figure 28:
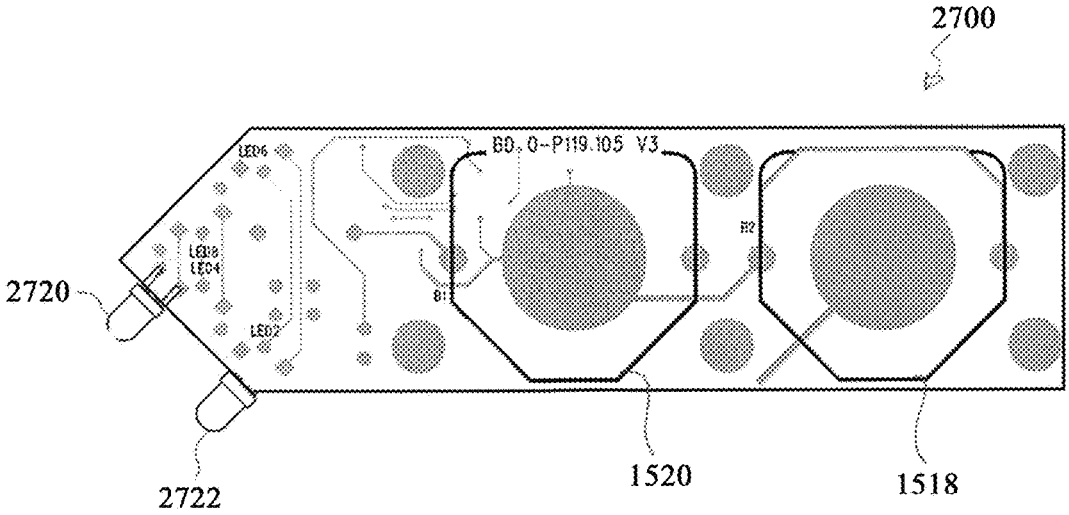
FIG. 28 is an inside surface view of the circuit board of FIG. 27.

FIG. 27 is an outside surface view of another embodiment of a circuit board 2700 for a weapon light according to aspects of the present disclosure. FIG. 27 is an inside surface view of the circuit board 2700. The circuit board 2700 is a right handed version with switches 1512, 1514 on a first surface 2704 and battery terminals 1580, 1520 on a second surface 2706. Here there are two separate LEDs 2720, 2722. These may be a combination of visible and IR LEDs that are activated by switches 1512, 1514 corresponding to the buttons 112, 114 or 812, 814 on the respective housing 102, 802.

Figure 29:
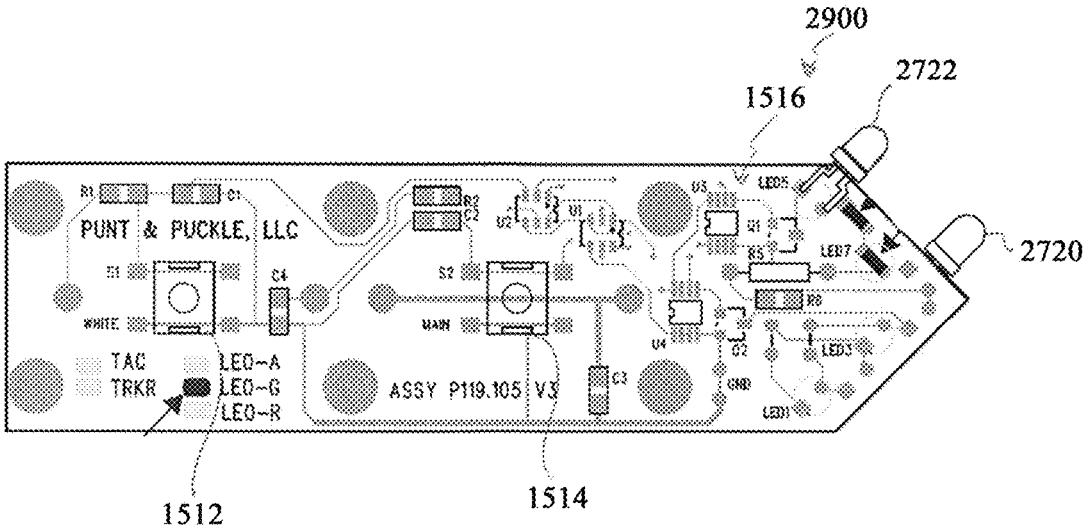
FIG. 29 is an outside surface view of another embodiment of a circuit board for a weapon light according to aspects of the present disclosure.
Figure 30:
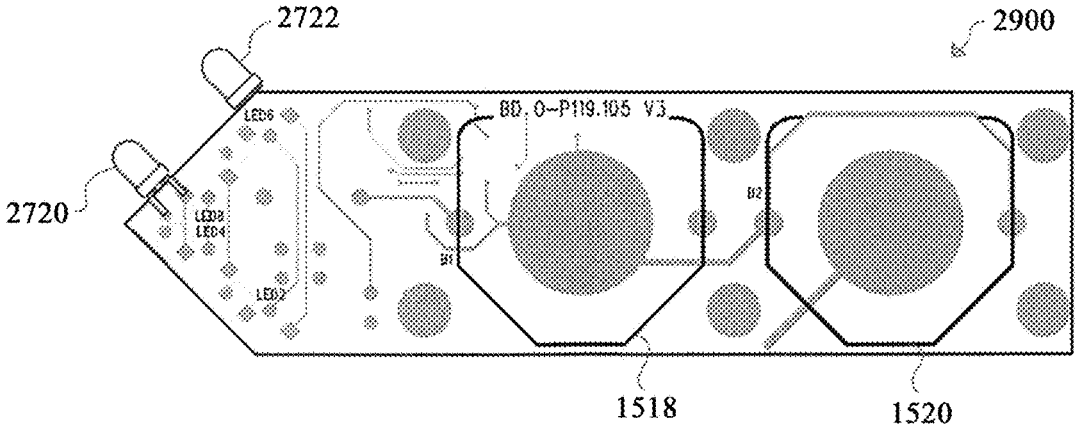
FIG. 30 is an inside surface view of the circuit board of FIG. 29.

FIG. 29 is an outside surface view and FIG. 30 is an inside surface view of a left handed circuit board 2900 version of the circuit board 2500. Again, an outer side 2904 and inner side 2906 correspond to outer side 2704 and inner side 2706, respectively, except for reversal of the location of components.

Figure 31:
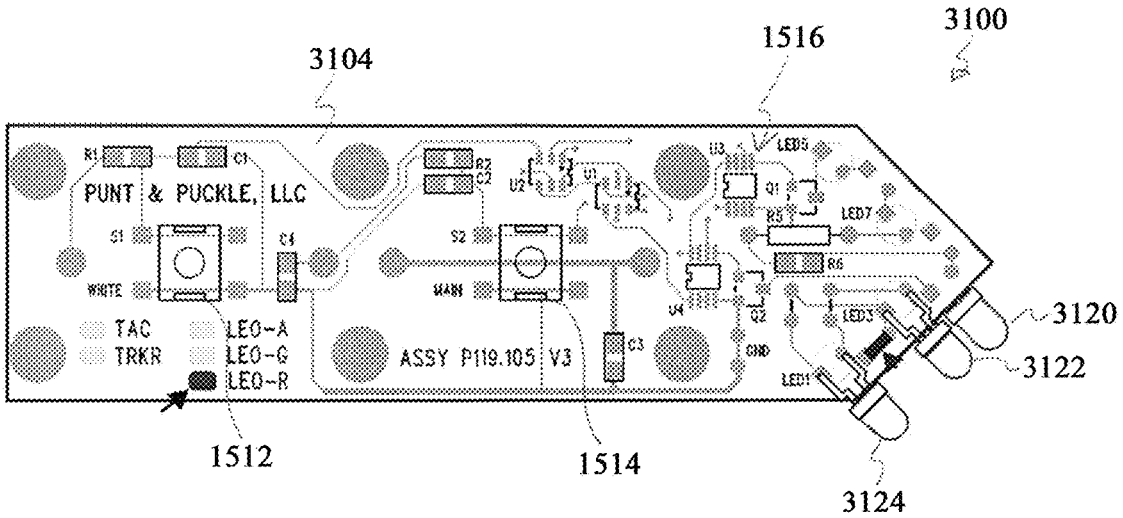
FIG. 31 is an outside surface view of another embodiment of a circuit board for a weapon light according to aspects of the present disclosure.
Figure 32:
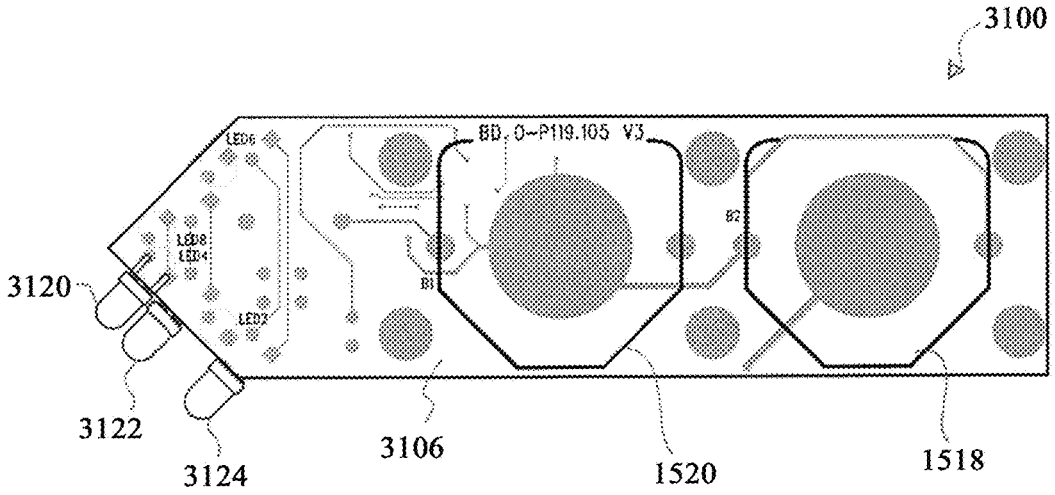
FIG. 32 is an inside surface view of the circuit board of FIG. 31.

FIG. 31 is an outside surface view of another embodiment of a circuit board 3100 for a weapon light according to aspects of the present disclosure. FIG. 32 is an inside surface view of the circuit board 3100. The circuit board 3100 is a right handed version with switches 1512, 1514 on a first surface 3104 and battery terminals 1580, 1520 on a second surface 3106. Here there are three separate LEDs 3120, 3122, 3124. These may be a combination of visible and IR LEDs that are activated by switches 1512, 1514 corresponding to the buttons 112, 114 or 812, 814 on the respective housing 102, 802.

Figure 33:
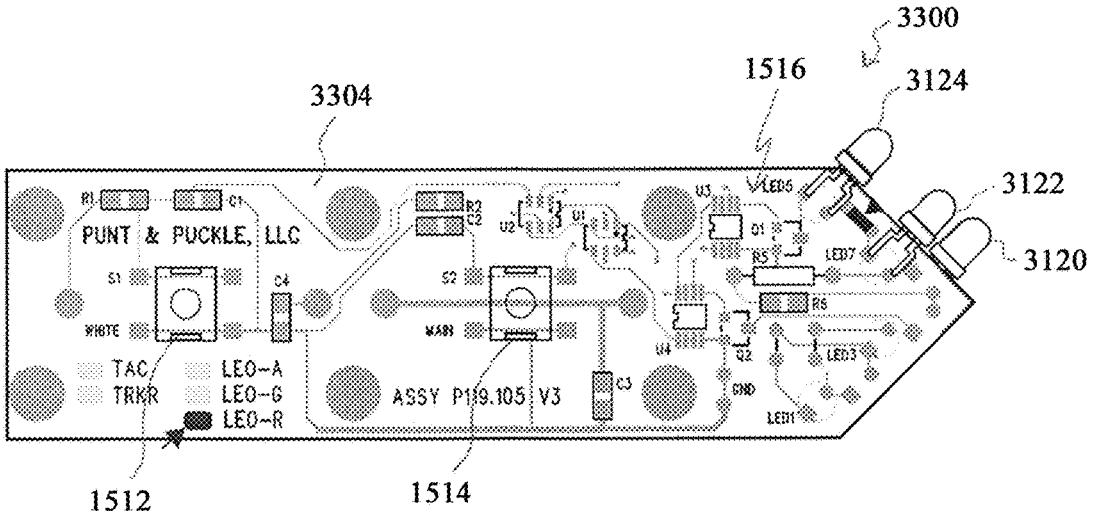
FIG. 33 is an outside surface view of another embodiment of a circuit board for a weapon light according to aspects of the present disclosure.
Figure 34:
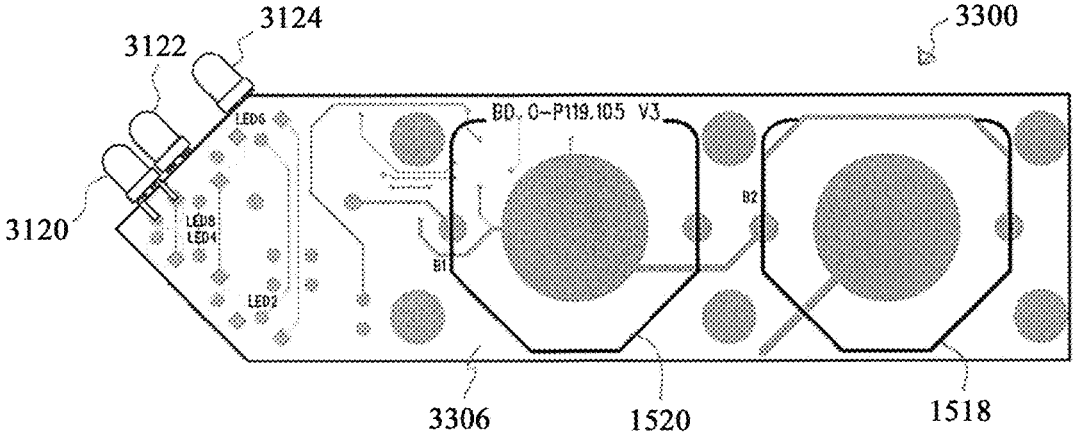
FIG. 34 is an inside surface view of the circuit board of FIG. 33.

FIG. 33 is an outside surface view and FIG. 34 is an inside surface view of a left handed circuit board 3300 version of the circuit board 3100. Again, an outer side 3304 and inner side 3306 correspond to outer side 3104 and inner side 3106, respectively, except for reversal of the location of components.

Figure 35:
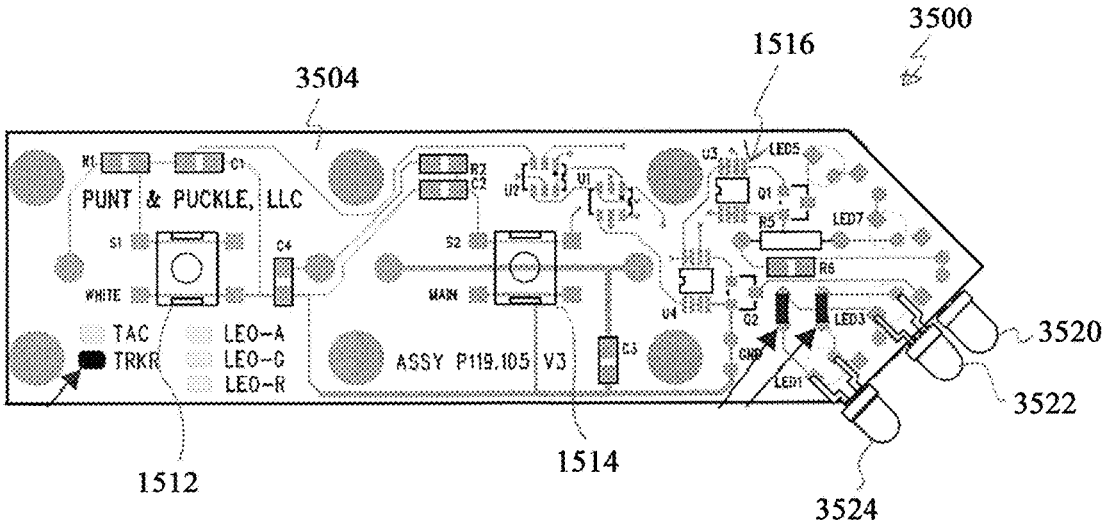
FIG. 35 is an outside surface view of another embodiment of a circuit board for a weapon light according to aspects of the present disclosure.
Figure 36:
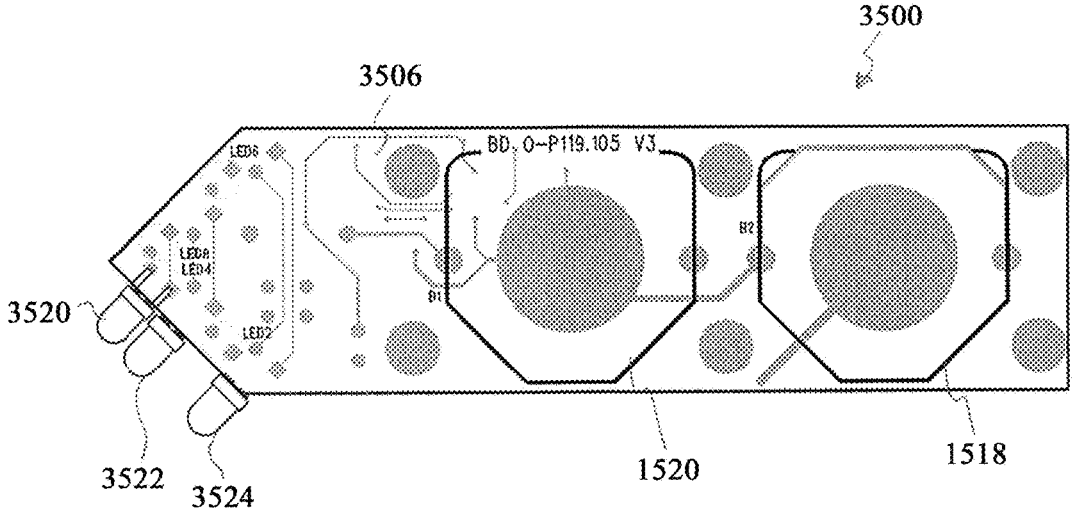
FIG. 36 is an inside surface view of the circuit board of FIG. 35.

FIG. 35 is an outside surface view of another embodiment of a circuit board 3500 for a weapon light according to aspects of the present disclosure. FIG. 36 is an inside surface view of the circuit board 3500. The circuit board 3500 is a right handed version with switches 1512, 1514 on a first surface 3504 and battery terminals 1580, 1520 on a second surface 3506. Here there are three separate LEDs 3520, 3522, 3524. These may be a combination of visible and IR LEDs that are activated by switches 1512, 1514 corresponding to the buttons 112, 114 or 812, 814 on the respective housing 102, 802.

Figure 37:
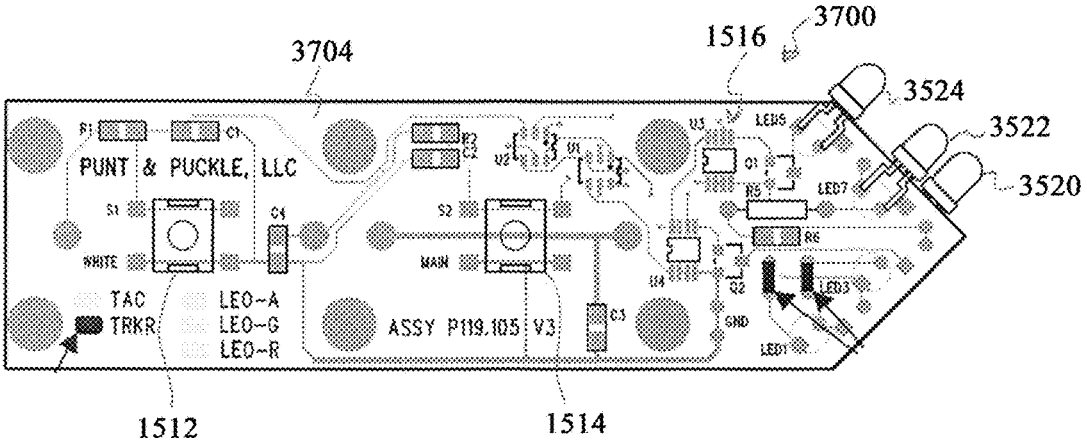
FIG. 37 is an outside surface view of another embodiment of a circuit board for a weapon light according to aspects of the present disclosure.
Figure 38:
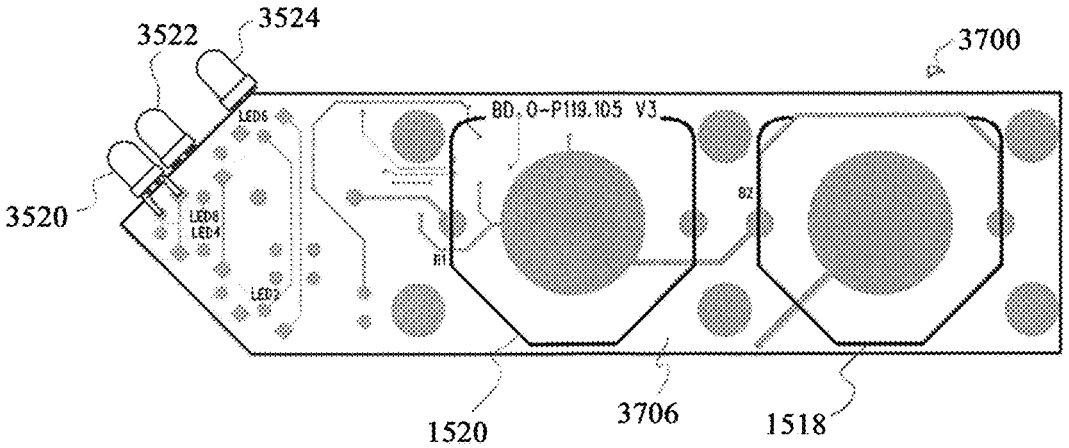
FIG. 38 is an inside surface view of the circuit board of FIG. 37.

FIG. 37 is an outside surface view and FIG. 38 is an inside surface view of a left handed circuit board 3300 version of the circuit board 3100. Again, an outer side 3704 and inner side 3706 correspond to outer side 3504 and inner side 3506, respectively, except for reversal of the location of components.

It will be appreciated with reference to FIGS. 15-38 that the underlying circuit boards may be equivalent insofar as placement of traces, connections points, and other components are concerned. If connection LED4 and LED8 are made functionally equivalent, either one of these may be used to the same effect to achieve right or left handed versions of the circuit. Similarly, LED3 and LED7 may be equivalent, LED2 and LED6 may be equivalent, and LED1 and LED5 may be equivalent. Thus, proper placement of the desired LEDs and placement of the circuit board properly in the housing reduces the number of parts needed to implement the various embodiments of the present disclosure.

Figure 39:
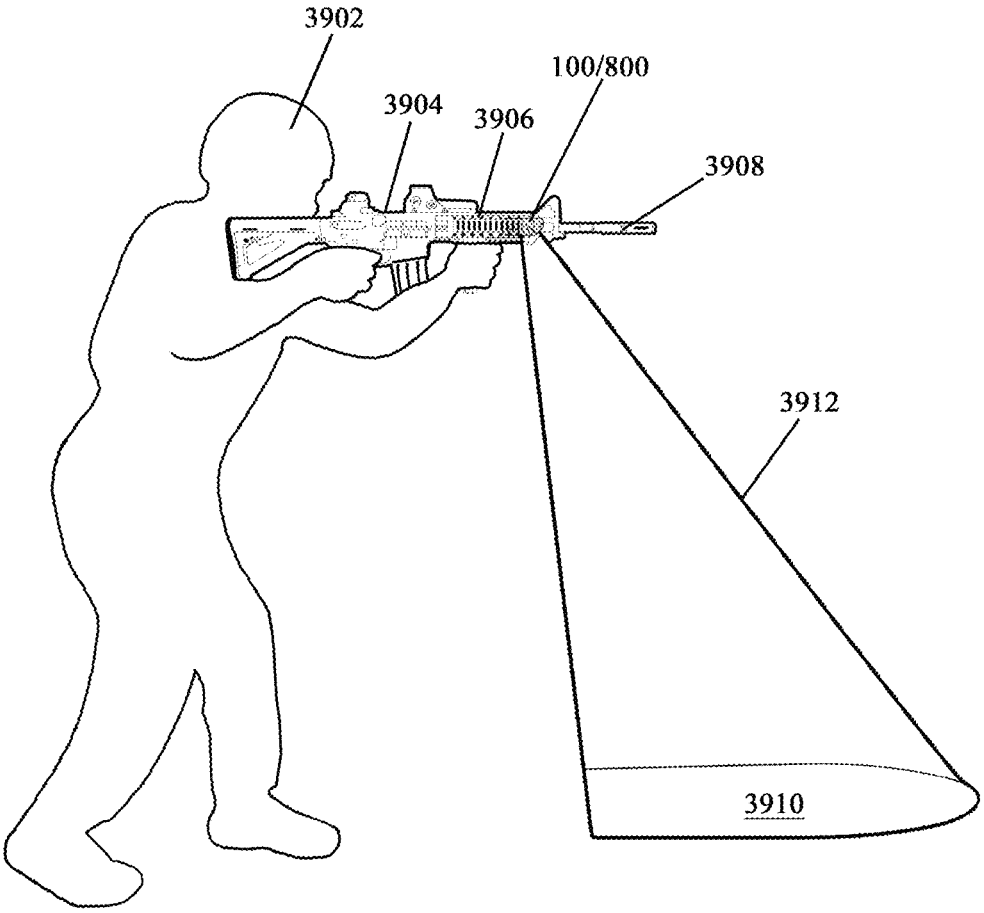
FIG. 39 is a simplified side view of an operator carrying a weapon with an installed weapon light according to aspects of the present disclosure.

Referring now to FIG. 39, a simplified side view of an operator 3902 carrying a weapon 3904 with an installed weapon light 100/500 according to aspects of the present disclosure is shown. The weapon 3904 may be a police rifle, personal defense rifle, assault rifle, or other hand or shoulder fired weapon of gun. A Picatinny rail 3906 is provided here in line with a bore 3908 of the weapon 3904. Light beams 3912 illustrate use of the light 100/800 for illuminating a footpath 3910 of the operator without lowering the weapon 3904 and without overly telegraphing the position of the operator 3902 to an enemy.

According to the present disclosure, in various embodiments, the light 100/800 is a stand-alone multi-spectrum illumination device. Embodiments of the present disclosure are designed with the tactical operator in mind. Such embodiments are designed to allow an operator to view his or her footpath (e.g., 3910) while not losing muzzle-to-target advantage (i.e. line of sight). Utilizing both IR visible LEDs, systems of the present disclosure allow an operator to choose the illumination type best suited for the mission at hand.

As described, the associated light elements 110 or LEDs may be mounted at a downward angle from direction of a bore 3908 at an angle best suited to view the operator's footpath 3940 while conducting tactical operations. The operation of the device may allow the user to choose the illumination desired one or more push button (e.g., 112, 118 or 812, 814). A primary, forward button 114/814, may be operated by the strong index finger and may activates dual IR LEDs, while a secondary button 112/812, possibly operated by the middle finger, operates visible/white LEDs. This front/rear activation design is deliberate as the forward strong/primary finger in a stressful situation would be most likely to involuntarily activate in a reactionary (i.e. kneejerk) situation therefore would not give away the operators' position to an opposing force unless said force were using night vision devices as well, which is a less-likely scenario.

A slight delay may be built into the control circuitry 1516 to reduce the chance of accidental activation. In some embodiments, operation of the light 100/800 may be as follows. Pushing the front button 114/814 once activates an IR light source (e.g., one or more IR light elements 110 or IR LEDs). Pushing the front button 114/814 again or pushing the rear button 112/812 cancels the IR light source. Pushing the rear button 112/812 activates visible light source (e.g., one or more visible light elements 110 or visible light LEDs). Pushing the rear button 112/812 again or pushing the front button 114/814 cancels the Visible light source.

Figure 40:
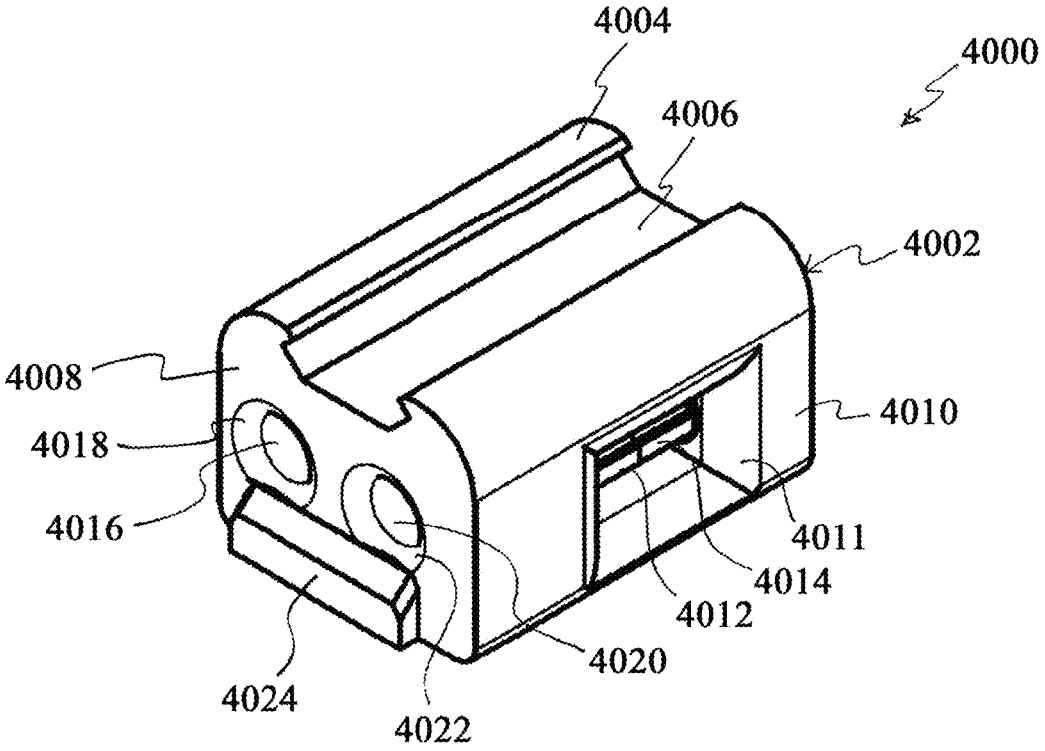
FIG. 40 is a top perspective view of another embodiment of a rail mountable light according to aspects of the present disclosure.

Referring now to FIG. 40, a top perspective view of another embodiment of a rail mountable light 4000 according to aspects of the present disclosure is shown. The light 4000 is similar in some of its operations to the lights 100/800 discussed above. However, the light 4000 is particularly adapted for mounting below the bore 3908 of a weapon 3904 or similar. In use, the light 4000 may selectively illuminate directly forward (in the direction of the bore 3908), and/or angled downward toward an operator's feet or path, both without movement of the weapon 3904 itself.

In various embodiments, the light 4000 comprises a rugged body 4002, which may comprise a polymer or other durable material. The body 4002 may also be constructed to as to be shock proof and/or waterproof. The body may comprise an upper panel 4004 having an accessory rail receiver 4006 affixed to or molded therein. As with previous embodiments, the receiver 4006 may securely grasp a Picatinny rail or other mounting location on a weapon. Cross bolts, bosses, screws or other implements fitting the rail may be employed as are known in the art if needed.

A forward panel 4008 may descend vertically or substantially vertically from the upper panel 4004. The forward panel 4008 may provide pair of front facing light elements 4016, 4020 and associated reflectors 4018, 4022, respectively. In some embodiments, the reflectors 4018, 4020 are recesses rather than providing any substantial reflection of light, as the associated light elements 4016, 4020 may be LEDs that may be focused by lenses or other structures as are known in the art.

A left panel 4010 provides a forward button 4012 and a rearward button 4014 that may be accessible by an operator to illuminate various individual lights, light elements, or LEDs associated with the light 4000. The buttons 4012, 4014 may be silent and/or rubber coated. They may be mechanical switches or soft switches to signal internal circuitry and/or controllers of the light 4000 to engage various functions of the individual light elements. In some embodiments, the buttons 4012, 4014 may be mounted into a recess 4011 of the left side panel 4010 to prevent inadvertent activation or abrasion damage.

Figure 41:
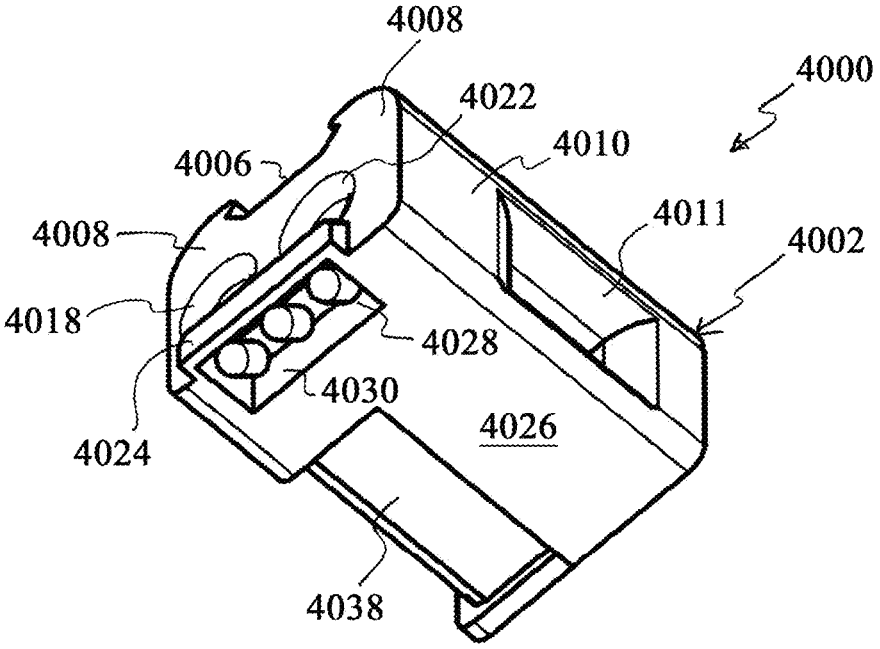
FIG. 41 is a lower perspective view of the rail mountable light of FIG. 40.

Referring now to FIG. 41, a lower perspective view of the rail mountable light 4000 of FIG. 40 is shown. Here a bottom panel 4026 can be seen to provide an array of downward angled light elements or LEDs 4028. These may be partially shielded by a hood 4024 that may extend from the forward panel 4008 and/or bottom panel 4026. In some cases, a reflector 4030 may be defined by the hood 4024 and/or bottom panel 4026. In other embodiments, the reflector 4030 is primarily or exclusively a recess into the bottom panel 2026 possibly joined by hood 4024.

In some embodiments, an access panel 4038 may be at least partially defined on the bottom panel 4026. This may be removable for accessing or replacing a power supply or other internal components. Screws, clamps, clasps, and other arrangements are known in the art can be used to open and secure the access panel 4038.

Figure 42:
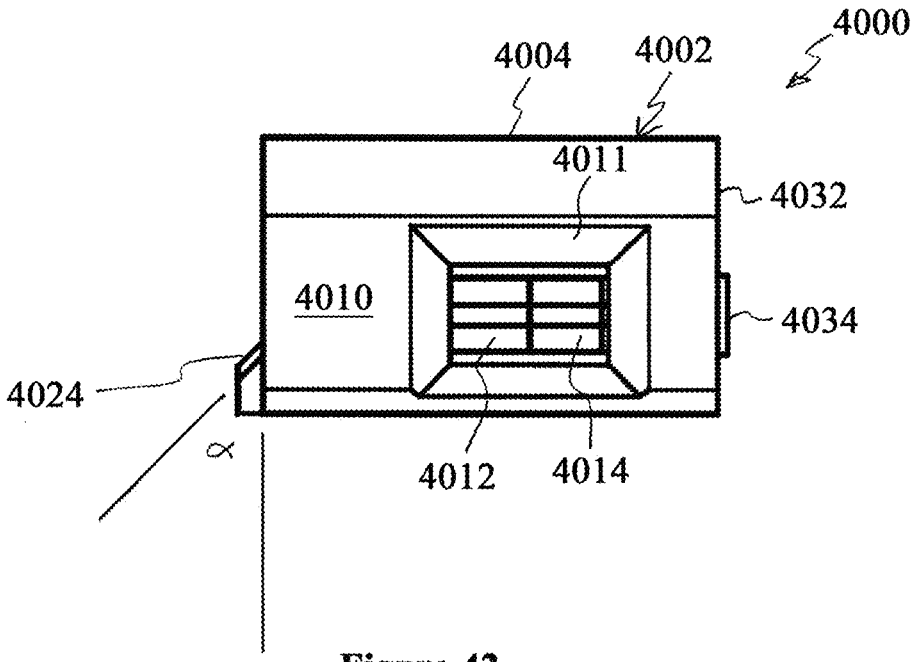
FIG. 42 is a left side view of the rail mountable light of FIG. 40.

With further references to FIG. 42, a left side view of the rail mountable light 4000 of FIG. 40 is shown. Here it is illustrated how the hood 4024 and/or recess 4030 provide for downward angled light projection from the LED array 4028. Light may be projected downward primarily within an angle $\alpha$. In some embodiments, light may be projected downward and away from the front panel 4024 and an angle of 45 degrees or less. This allows for a degree of forward illumination (e.g., to illuminate a foot path) but does not shine forward in the direction of the weapon bore 3908. The light elements 4016, 4020 can be selectively activated when forward directed light is desired.

Figure 43:
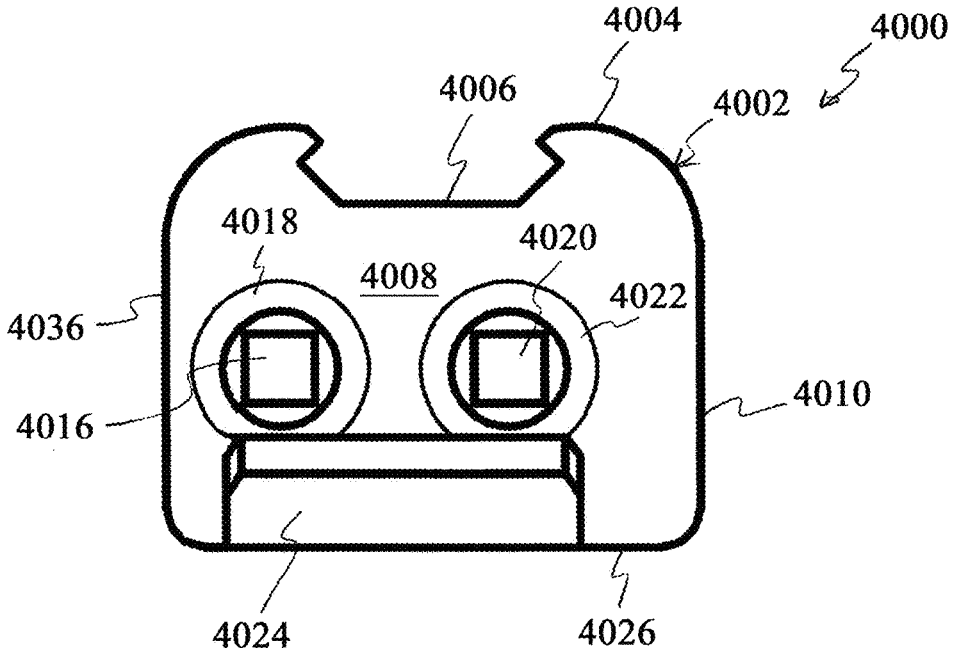
FIG. 43 is a front view of the rail mountable light of FIG. 40.
Figure 44:
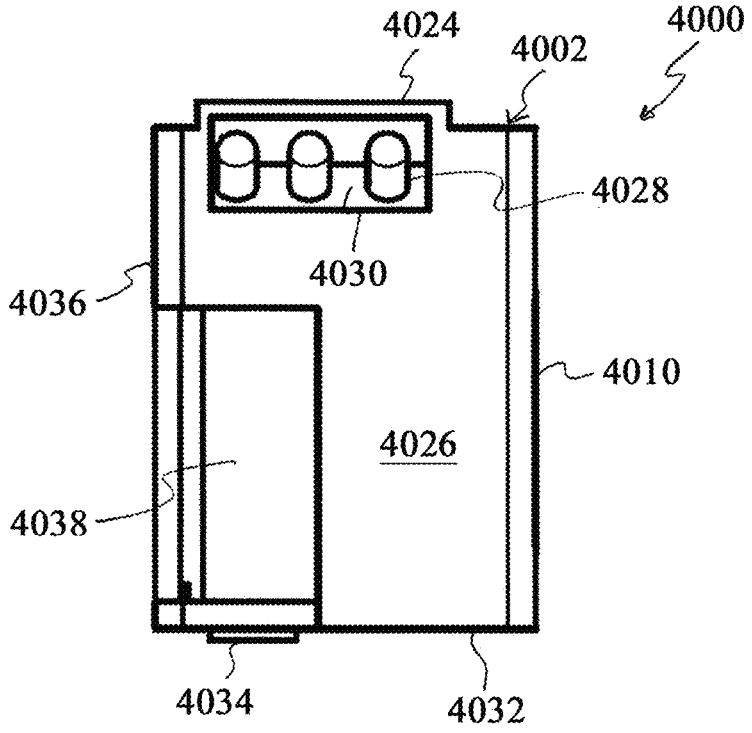
FIG. 44 is a bottom view of the rail mountable light of FIG. 40.

FIG. 43 is a front view of the rail mountable light 4000 of FIG. 40. FIG. 44 is a bottom view of the rail mountable light 4000 of FIG. 40. As shown in FIG. 44, a main power switch 4034 may be provided. This switch 4034 may be a soft switch or a mechanical device. This switch 4034 may power up the light 4000 and make it ready for use. Buttons 4012, 4014 may be used to activate front light elements 4016, 4022 and LED array 4028 respectively.

The body 4002 can also be seen to have a right panel 4036. In some embodiments, this panel 4036 may contain no controls. The panel 4036 may accept, define, or secure a portion of the access panel 4038. Some embodiments may replicate the controls from the left panel 4010 on the right panel 4036 (e.g., buttons 4012, 4014) making the device 4000 ambidextrous. In other embodiments, the configuration of the panels 4010, 4036 may be reversed (e.g., such that the buttons 4012, 4014 are only on the right panel 4036 and the left panel 4010 is blank or accepts part of access panel 4038). The body 4002 can be seen to be rectilinear or planar in shape, with some edges between panels being rounded.

Two front light elements 4016, 4022 are shown but more may be provided. These may be white lights, colors lights, infrared lights or others. Various light types and colors may be selected, for example, by repeated presses of the front button 4012. Similarly, the LED array 4028 may contain more or fewer LEDs than shown and these may provide a plurality of light types, including, but not limited to white, colored, and infrared. Different types of light may be enabled by repeated presses of button 4014, for example. Buttons 4012, 4014 may also be used to select differing levels of illumination, flashing, or other effects. Long presses may be used in this regard, for example.

Internal circuitry of the light 4000 may be similar to that discussed above with respect to lights 100/800. In other embodiment's other lighting and control circuitry as is known in the art, or may be readily developed by one of skill in the art, may be employed.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

The term "at least" followed by a number is used herein to denote the start of a range beginning with that number (which may be a ranger having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%.

When, in this document, a range is given as "(a first number) to (a second number)" or "(a first number)—(a second number)", this means a range whose lower limit is the first number and whose upper limit is the second number. For example, 25 to 100 should be interpreted to mean a range whose lower limit is 25 and whose upper limit is 100. Additionally, it should be noted that where a range is given, every possible subrange or interval within that range is also specifically intended unless the context indicates to the contrary. For example, if the specification indicates a range of 25 to 100 such range is also intended to include subranges such as 26-100, 27-100, etc., 25-99, 25-98, etc., as well as any other possible combination of lower and upper values within the stated range, e.g., 33-47, 60-97, 41-45, 28-96, etc. Note that integer range values have been used in this paragraph for purposes of illustration only and decimal and fractional values (e.g., 46.7-91.3) should also be understood to be intended as possible subrange endpoints unless specifically excluded.

It should be noted that where reference is made herein to a method comprising two or more defined steps, the defined steps can be carried out in any order or simultaneously (except where context excludes that possibility), and the method can also include one or more other steps which are carried out before any of the defined steps, between two of the defined steps, or after all of the defined steps (except where context excludes that possibility).

Further, it should be noted that terms of approximation (e.g., "about", "substantially", "approximately", etc.) are to be interpreted according to their ordinary and customary meanings as used in the associated art unless indicated otherwise herein. Absent a specific definition within this disclosure, and absent ordinary and customary usage in the associated art, such terms should be interpreted to be plus or minus 10% of the base value.

Thus, the present invention is well adapted to carry out the objects and attain the ends and advantages mentioned above as well as those inherent therein. While the inventive device has been described and illustrated herein by reference to certain preferred embodiments in relation to the drawings attached thereto, various changes and further modifications, apart from those shown or suggested herein, may be made therein by those of ordinary skill in the art, without departing from the spirit of the inventive concept the scope of which is to be determined by the following claims.

What is claimed is:

1. A weapon light comprising:

a body comprising a top panel, a bottom panel, a left panel, a right panel, a front panel, and a rear panel;

an accessory rail interface on the top panel configured to selectively attach to a weapon accessory rail below a bore of the weapon, the body then being aligned with the firearm such that the front panel is pointed in a same direction as the bore;

a plurality of light control buttons on left panel accessible to an operator of the firearm; and a first plurality of lights capable of emitting light in plurality of spectra, the first plurality of lights being fixed with respect to the body to illuminate an area in front of and below the weapon light such that a footpath of the operator can be illuminated by the plurality of lights while the bore of the weapon is pointed away from the operator;

a second plurality of lights capable of emitting light in plurality of spectra, the first plurality of lights being fixed with respect to the body to illuminate an area in front of the bore of the weapon;

wherein the plurality of light control buttons may be selectively and independently activated to activate the first plurality of lights and the second plurality of lights;

wherein the first plurality of lights illuminates an area below the weapon that is not illuminated by the second plurality of lights.

2. The weapon light of claim 1, wherein the first plurality of lights comprise a first plurality of light emitting diodes.

3. The weapon light of claim 2, wherein at least some of the first plurality of light emitting diodes are affixed with respect to the body to emit light 45 degrees downward and forward from the body and the bore.

4. The weapon light of claim 3, further comprising a visor affixed to the body on the front panel shielding forward emission of light from the first plurality of light emitting diodes.

5. The weapon light of claim 4, wherein the left panel defines a recess surrounding the plurality of light control buttons.

6. A weapon light comprising:

a body having an upper panel with an accessory rail interface;

a front panel joined to the upper panel and providing at least one forward facing light element;

a lower panel joined to the front panel and providing at least one downward angled light element; and a side panel joining the front panel and the lower panel and providing a first button controlling activation of the at least one forward facing light element and a second button controlling activation of the at least one downward angled light element;

wherein, with the accessory rail interface attached to a weapon accessory rail below a bore of the weapon, the front panel directs the at least one forward facing light in a direction the bore points and the lower panel directs the at least one downward angled light below the direction the bore points; and wherein the downward angled light illuminates an area below the bore of the weapon at the feet of an operator not illuminated by the forward facing light when the operator points the bore away from the operator.

7. The weapon light of claim 6, wherein, with the accessory rail interface attached to a weapon accessory rail below a bore of the weapon, the lower panel directs the at least one downward angled light to shine 45 degrees below the direction the bore points.

8. The weapon of light of claim 6, wherein a hood shields the at least one downward angled light element from shining in a direction faced by the front panel.

9. The weapon light of claim 8, wherein the hood extends from the front panel.

10. The weapon light of claim 9, wherein the at least one downward angled light element comprises a plurality of light emitting diodes (LEDs) emitting a plurality of spectra.

11. The weapon light of claim 10, wherein the at least one forward facing light element comprises a plurality of LEDs emitting a plurality of spectra.

* * * * *